US005293198A

United States Patent [19]

Sawayama et al.

[11] Patent Number: 5,293,198

[45] Date of Patent: Mar. 8, 1994

[54] IMAGE FORMING APPARATUS FOR CONTROLLING THE DYNAMIC RANGE OF AN IMAGE

[75] Inventors: Noboru Sawayama, Tokyo; Katsuhiro Aoki, Yokohama; Takayuki Maruta, Tokyo, all of Japan

[73] Assignee: Ricoh Company, Ltd., Tokyo, Japan

[21] Appl. No.: 742,896

[22] Filed: Aug. 8, 1991

[30] Foreign Application Priority Data

| | | | |
|---|---|---|---|
| Aug. 10, 1990 | [JP] | Japan | 2-213340 |
| Aug. 20, 1990 | [JP] | Japan | 2-219807 |
| Nov. 7, 1990 | [JP] | Japan | 2-301421 |
| Jun. 21, 1991 | [JP] | Japan | 3-150345 |

[51] Int. Cl.[5] ..... G03G 21/00

[52] U.S. Cl. ..... 355/214; 355/205; 355/208; 355/246

[58] Field of Search ..... 355/208, 209, 214, 246, 355/205-207, 326, 327

[56] References Cited

U.S. PATENT DOCUMENTS

| | | | |
|---|---|---|---|
| 4,179,213 | 12/1979 | Queener | 355/208 |
| 4,313,671 | 2/1982 | Kuru | 355/214 |
| 4,502,778 | 3/1985 | Dodge et al. | 355/246 X |
| 4,572,654 | 2/1986 | Murai et al. | 355/214 |
| 4,647,184 | 3/1987 | Russell et al. | 355/208 |
| 4,780,744 | 10/1988 | Porter et al. | 355/208 |
| 4,829,336 | 5/1989 | Champion et al. | 355/246 |
| 4,837,600 | 6/1989 | Kasai et al. | 355/208 |
| 4,888,636 | 12/1989 | Abe | 355/326 X |
| 4,951,088 | 8/1990 | Bonvallet et al. | 355/208 X |
| 4,962,407 | 10/1990 | Ueda | 355/208 |
| 5,097,293 | 3/1992 | Seto et al. | 355/208 |

FOREIGN PATENT DOCUMENTS

| | | | |
|---|---|---|---|
| 0354128 | 2/1990 | European Pat. Off. . | |
| 3340959 | 5/1984 | Fed. Rep. of Germany . | |
| 0033134 | 2/1983 | Japan . | |
| 0146256 | 8/1985 | Japan | 355/214 |
| 2212419 | 7/1989 | United Kingdom . | |

*Primary Examiner*—A. T. Grimley
*Assistant Examiner*—Robert Beatty
*Attorney, Agent, or Firm*—Allen S. Melser

[57] ABSTRACT

An image forming apparatus has a photoconductive element, a developing sleeve, a photosensor and a control device for controlling the dynamic range of an image. A background output VSG is produced from the photosensor when the photoconductive element is rotating and the developing sleeve is rotating and a background output VSG+ is produced from the photosensor when the photoconductive element is rotating and the developing sleeve is not rotating. The control device controls a developing bias, a charge potential, a quantity of exposing light or an amount of toner supply in response to the greater of the two values VSG or VSG+. Also, the gradient of the background output VSG is determined and is used to decide whether the image forming apparatus is in an unusual state or not.

9 Claims, 28 Drawing Sheets

IMAGE FORMING APPARATUS FOR CONTROLLING THE DYNAMIC RANGE OF AN IMAGE

BACKGROUND OF THE INVENTION

The present invention relates to color image forming equipment and, more particularly, to a digital color copier of the type using a developer made up of a toner and a carrier, i.e., a two-component developer.

A prerequisite with a digital color copier of the type described is that the toner concentration of the two-component developer be adequately regulated to enhance the reproducibility of tones, especially halftone, of images. To meet this requirement, various toner concentration control methods have heretofore been proposed. The conventional methods may generally be classified into two types, as follows:

Type A: sensing toner concentration or a substitute characteristic and controlling it to a predetermined one; and Type B: sensing the developing ability of a developer or a substitute characteristic and controlling toner concentration such that the developing ability remains constant.

The type A method consists in, for example, detecting changes in the volume density of a developer (Japanese Patent Laid-Open Publication No. 5487/1972), detecting changes in the volume density of a developer in terms of changes in magnetic permeability or reactance (Japanese Patent Laid-Open Publication No. 5138/1972), detecting changes in the volume of a developer (Japanese Patent Laid-Open Publication No. 19459/1975), detecting changes in the volume of a developer in terms of changes in torque (Japanese Patent Laid-Open Publication No. 6598/1972), detecting changes in the tone of a developer (Japanese Patent Laid-Open Publication No. 69527/1973), detecting changes in the electric resistance of a developer (Japanese Patent Laid-Open Publication No. 38157/1973), or detecting a voltage induced by the counter charge (on a carrier) of a developed toner (Japanese Patent Laid-Open Publication Nos. 57638/1973 and 42739/1973). Type-B methods include formation and developement of a charge pattern which is invariant with any photoconductive body, so as to optically sense the density of a resulting toner image.

Such a prior art method, whether it be of type A or type B, cannot satisfactorily reproduce halftone images. Specifically, toner concentration generally changes with the ambient conditions and due to aging. Hence, the type A method which maintains toner concentration constant causes the developing characteristic of the developer to change due to changes in ambient conditions and aging. This type of method, therefore, is not directly applicable to a color copier which attaches importance to the reproducibility of halftone. In the light of this, there have also been proposed a control method which controls the quantity of exposing light by sensing ambient conditions as well as other factors (Japanese Patent Laid-Open Publication No. 177153/1988), and a control method which develops a plurality of potential patterns, optically senses the densities of the resulting toner images, and selects adequate one of exposing potential data which were measured in various environments (Japanese Patent Laid-Open Publication No. 296061/1988). These methods, however, cannot cope with changes in the charging characteristic of a developer due to aging. Although they will be capable of coping with such changes if provided with data covering both the aging and the ambient conditions, preparing such an amount of data is not practical. Moreover, optimizing the developing characteristic by any of the above-mentioned methods is almost impracticable since toner concentration is susceptible to operation modes as well as to aging and ambient conditions.

The type A method is not satisfactory not only from the standpoint of the above-discussed optimization of developing characteristic but also from the standpoint of adequate toner concentration. Specifically, the limit of toner concentration at which the contamination of background and the scattering of toner sharply increase is also susceptible to changes in ambient conditions and aging. It follows that controlling the toner concentration to a predetermined one as with the type A method is apt to bring about the contamination of background and the scattering of toner due to changes in ambient conditions and aging. As a result, even when the developer is still usable, it is often determined that it should be replaced with fresh one. Concerning the type B method which so controls the toner concentration as to maintain the developing ability constant, all the changes in the developer ascribable to the environment and aging are fed back to the toner concentration, broadening the range over which the toner concentration is varied. Consequently, the developing ability of the developer is increased in a high humidity environment or in an aged condition. In this condition, should the toner concentration be reduced to control the developing ability to a usual one, the resulting toner concentration would be excessively low to in turn reduce the maximum amount of development, i.e., saturation image density. For this reason, the halftone reproducibility achievable with the type B method is as poor as the type A method.

We have already proposed control methods capable of eliminating the above problems in copending U.S. patent application Ser. No. 07/545,508 filed Jun.29. 1990 and Japanese Patent Application No. 238107/1989. With such methods, it is possible to achieve a stable image density, especially halftone reproducibility, despite the changes in ambient conditions and aging.

Regarding the control over the toner supply, it sometimes occurs that the amount of toner deposition on the photoconductive element abruptly increases due to, among others, the change in the characteristic of the developer ascribable to the ambient conditions and other factors. Especially, in the case of a color toner, since a diffused reflection from the toner deposited on the photoconductive element and, therefore, the quantity of light incident to an optical sensor increases with the increase in the amount of toner deposition. Therefore, the amount of toner deposition is apt to be erroneously determined as being low. Then, the toner supply would be continued to increase the toner density to an excessive degree. To eliminate such an occurrence, it has been customary to control the toner supply on the basis of a relation between the background voltage Vsg+matching the quantity of a reflection from the photoconductive element detected when the developing sleeve was halted and the photoconductive element was in operation, and the background voltage Vsg detected when the developing sleeve was in operation. Specifically, when Vsg+ <Vsg, whether (I) Vsp (target value)×4/Vsg>Vsp or (II) Vsp×4/Vsg+<Vsp is determined. The toner is supplied only if the condition (II) is satisfied.

However, the problem with the above-stated scheme is that when the voltage Vsg detected when the developing sleeve was in operation becomes higher than the voltage Vsg+detected when it was in a halt, the condition (II) holds to cause the toner to be continuously supplied. This is also apt to result in the uncontrollable increase in toner concentration. Specifically, the reversal of the relation between the detected voltages of interest stems from the fact that the amount of toner remaining on the background increases when, for example, the photoconductive element is not completely cleaned or when the toner density is increased to an unusual degree. Besides, the control over the toner density often fails when an error occurs in the image forming system including the photoconductive element.

SUMMARY OF THE INVENTION

It is therefore an object of the present invention to provide color image forming equipment capable of reproducing image densities and halftone images stably at all times with no regard to varying ambient conditions.

It is another object of the present invention to provide color image forming equipment which eliminates the uncontrollable increase in toner density despite the erroneous detection of the background potential of a photoconductive element and detects an error which may occur in an image forming system including the photoconductive element.

It is another object of the present invention to provide generally improved image forming equipment.

In accordance with the present invention, image forming equipment for electrostatically forming a latent image on a photoconductive element and developing the latent image by a developer containing at least a toner to produce a corresponding toner image on the photoconductive element has a developing section comprising a developing sleeve for forming a predetermined toner image pattern on the photoconductive element, a photosensor for sensing a reflection from the toner image pattern, and a control section for changing at least one of the developing bias, charge potential and quantity of exposing light in response to the output signal of the photosensor representative of a reflection incident to the photosensor. The control section calculates a reference value of the toner pattern on the basis of either one of the output signal of the photosensor appearing when the developing sleeve of the developing section is halted and the photoconductive element is rotating and the output of the photosensor appearing when the developing sleeve is rotated which signal is greater than the other, and changes at least one of the developing bias, charge potential and quantity of exposing light on the basis of the reference value and the amount of toner deposition on the toner image pattern.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
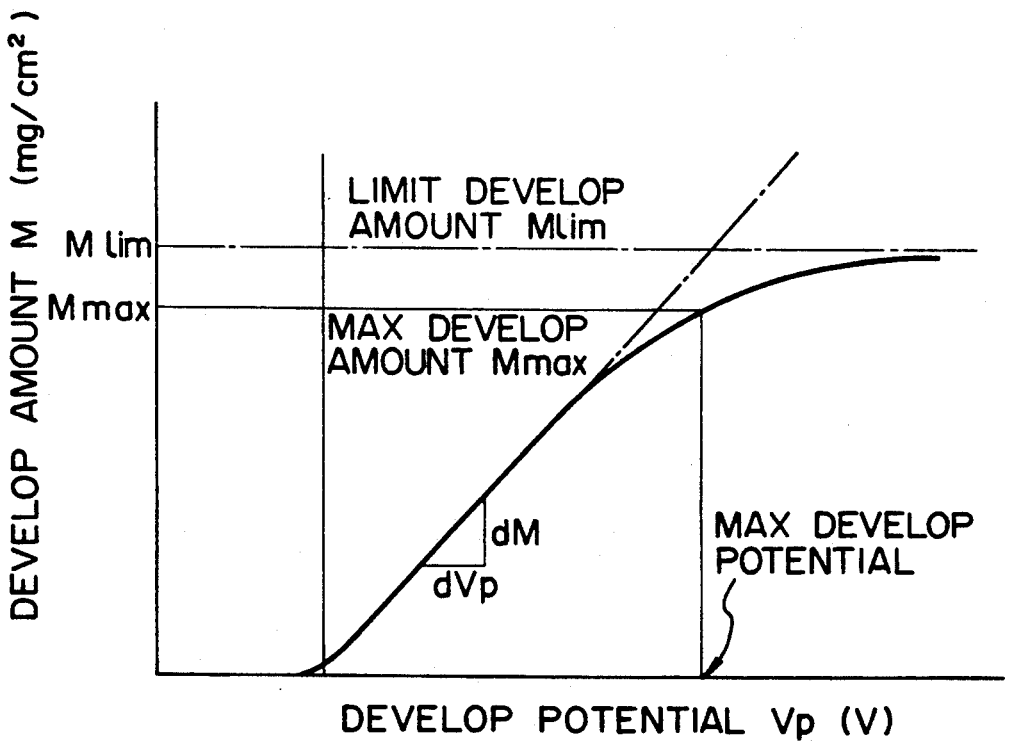
FIG. 1 is a graph representative of a developing characteristic.
Figure 2:
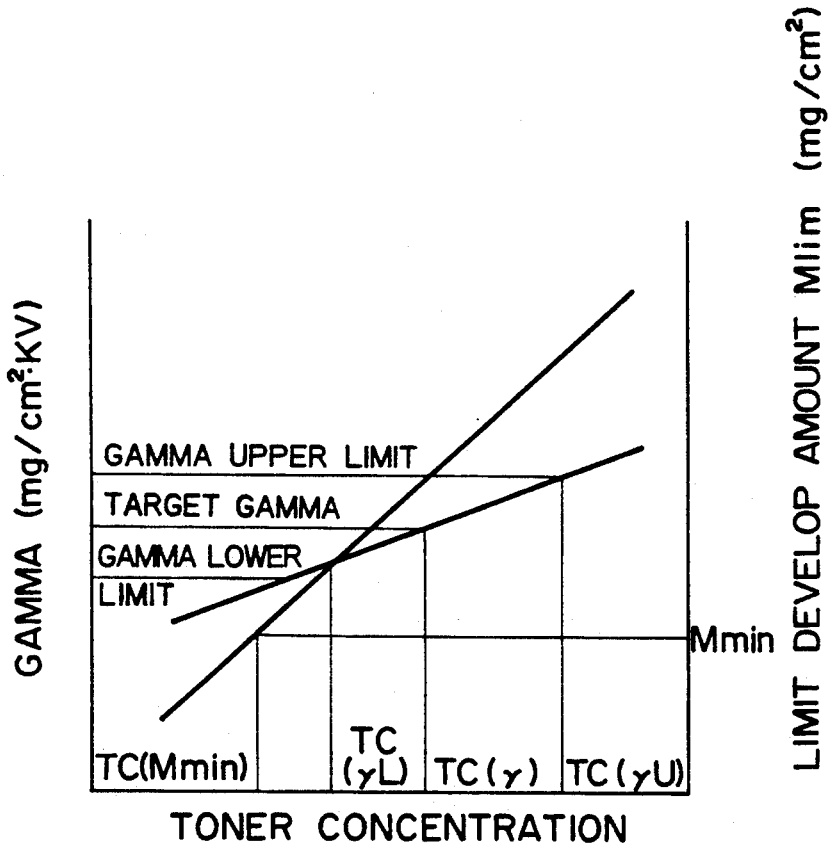
FIG. 2 is a graph indicating the dependency of a developing characteristic on toner concentration.

To better understand the present invention, a developing system of the type using a two-component developer will be described generically. FIG. 1 shows a developing characteristic particular to this type of developing system. As shown, the developing characteristic has two different ranges, i.e., a linear range in which the developing amount M linearly increases with the increase in the developing potential Vp, and a saturation range in which the former gradually approaches the limit developing amount Mlim away from the line in the linear range with the increase in the latter. The gradient dM/dVp of the linear range is generally referred to as development gamma. As shown in FIG. 2, both the gamma and the limit developing amount Mlim are dependent on the concentration of toner in a developer, i.e., the former increases with the increase in the latter. Regarding the reproducibility of a halftone image, a prerequisite with this type of developing system is that limit developing amount Mlim be sufficiently greater than the developing amount Mmax corresponding to the maximum developing potential of the system. Specifically, the system has to be used in the linear range in order to enhance the reproducibility of tones. The lower limit of toner concentration, therefore, should be limited by some means or method.

Figure 3:
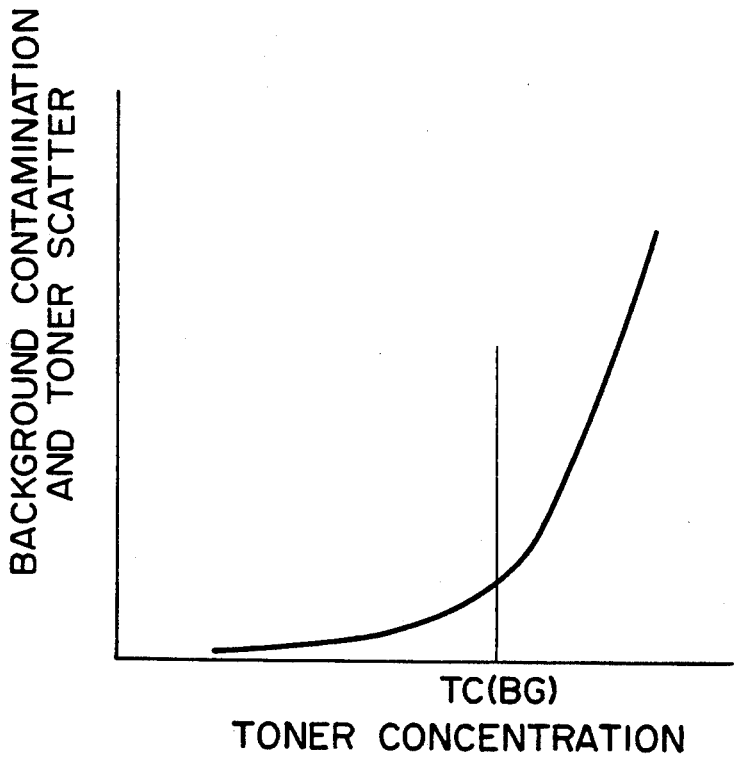
FIG. 3 is a graph indicating the dependency of background contamination and other occurrences on toner concentration.

On the other hand, as FIG. 3 indicates, toner concentrations higher than a certain value TC (BG) cause toner particles to deposit on and contaminate the background and to scatter around off the developer to the outside of a developing unit, for the following reasons. Carrier and toner particles constituting a two-component developer rub against each other and are charged thereby. Hence, when the amount of toner is excessive relative to the limited effective charging area of the carrier, the toner cannot be sufficiently charged and are, therefore, separated from the carrier to cause the above-mentioned undesirable occurrence. It follows that the toner concentration has to be provided with an upper limit by some means or methods.

Figure 4:
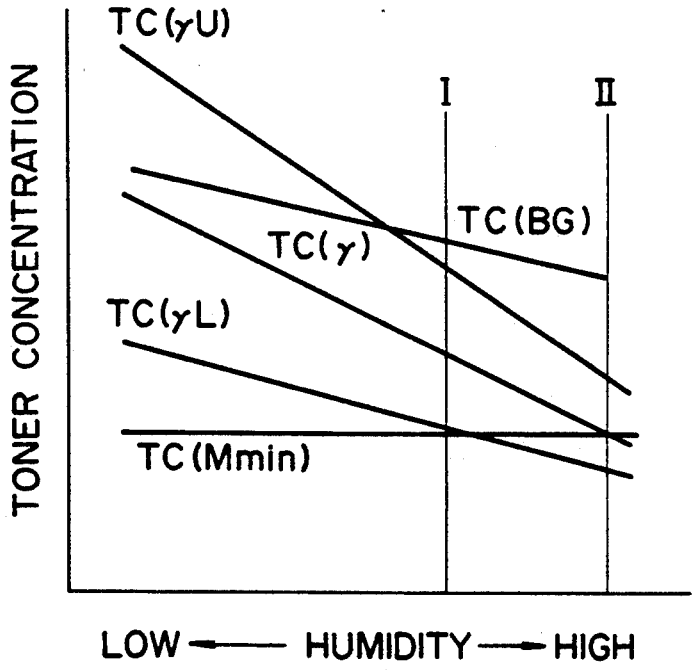
FIG. 4 is a graph showing the variation of toner concentration due to the variation of an ambient condition.
Figure 5:
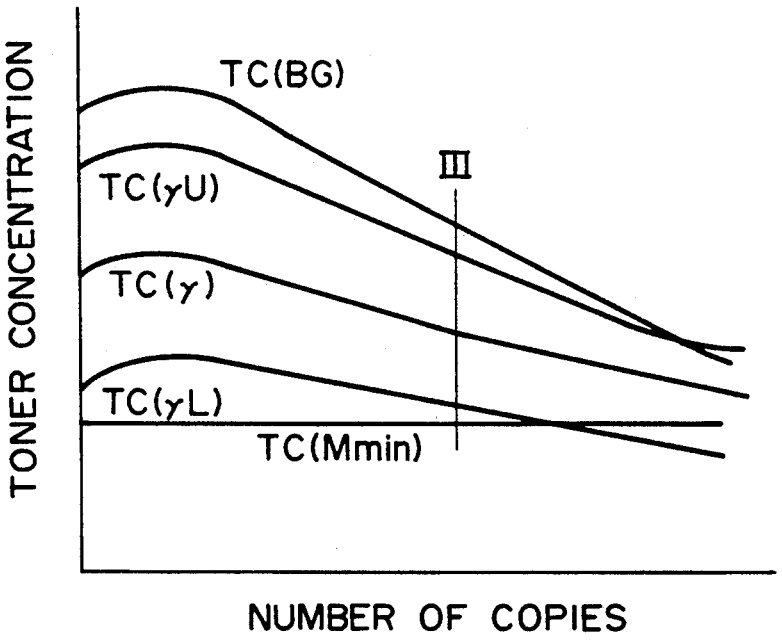
FIG. 5 is a graph representative of the variation of toner concentration due to aging.

Generally, the developing characteristic of and the background contamination by a two-component type developer stated above changes every moment depending on ambient conditions in which the machine is operated or left non-operated, the duration of non-operation, the number of times that copies are produced, etc. Presumably, this is ascribable to the amount of adsorption of water molecules by the surface of toner and carrier which varies with temperature and humidity, the amount of deposition of impurities on the carrier surface which varies with duration of operation, and the variation of the charging and discharging amounts of toner (and carrier). FIGS. 4 and 5 show how the toner concentration which determines the characteristic points of developing characteristic varies with the ambient conditions and due to aging, by using specific values determined by experiments. FIG. 4 shows the toner concentration in relation to the variation in humidity which is one typical ambient condition. The characteristic shown in FIG. 4 was measured with the number of copies produced being fixed to a particular number represented by III in FIG. 5. FIG. 5 shows a characteristic measured by taking account of aging, i.e., with the number copies produced being increased. The curves of FIG. 5 were attained with the ambient conditions being maintained constant, i.e., with the humidity being fixed at I shown in FIG. 4. Actually, these variations are combined with each other as well as with other variations such as one ascribable to the operation modes including the area ratio of a document, how many copies should be produced with a single copy, how many copies should be produced by one operation, and how long the machine has been left non-operated as counted from the last copying operation.

In FIGS. 2, 4 and 5, a curve TC(Mmin) indicates toner concentrations which prevents the developing amount Mmax associated with the maximum potential of the developing system from becoming less than the minimum necessary developing amount of the system. A curve TC($\gamma$) indicates toner concentrations which allow the gamma to coincide with the target value. A curve TC($\gamma$U) is representative of the upper limit of gamma required with the system; higher toner concentrations would thicken characters and/or result in short resolutions. Further, a curve TC($\gamma$L) is the lower limit of gamma which is required with the system; lower toner concentration would lower the image density beyond an allowable range. It is to be noted that the curve TC($\gamma$L) was estimated by using the linear portion of the developing characteristic and, in practice, the image density will be further lowered due to the previously mentioned saturation.

In any case, in the developing system using a two-component type developer, the toner concentration has a critical effect on the developing characteristic and, therefore, has to be adequately controlled. While the previously stated control methods A and B have been proposed in the past, they are not fully satisfactory for the reasons discussed earlier.

Figure 6:
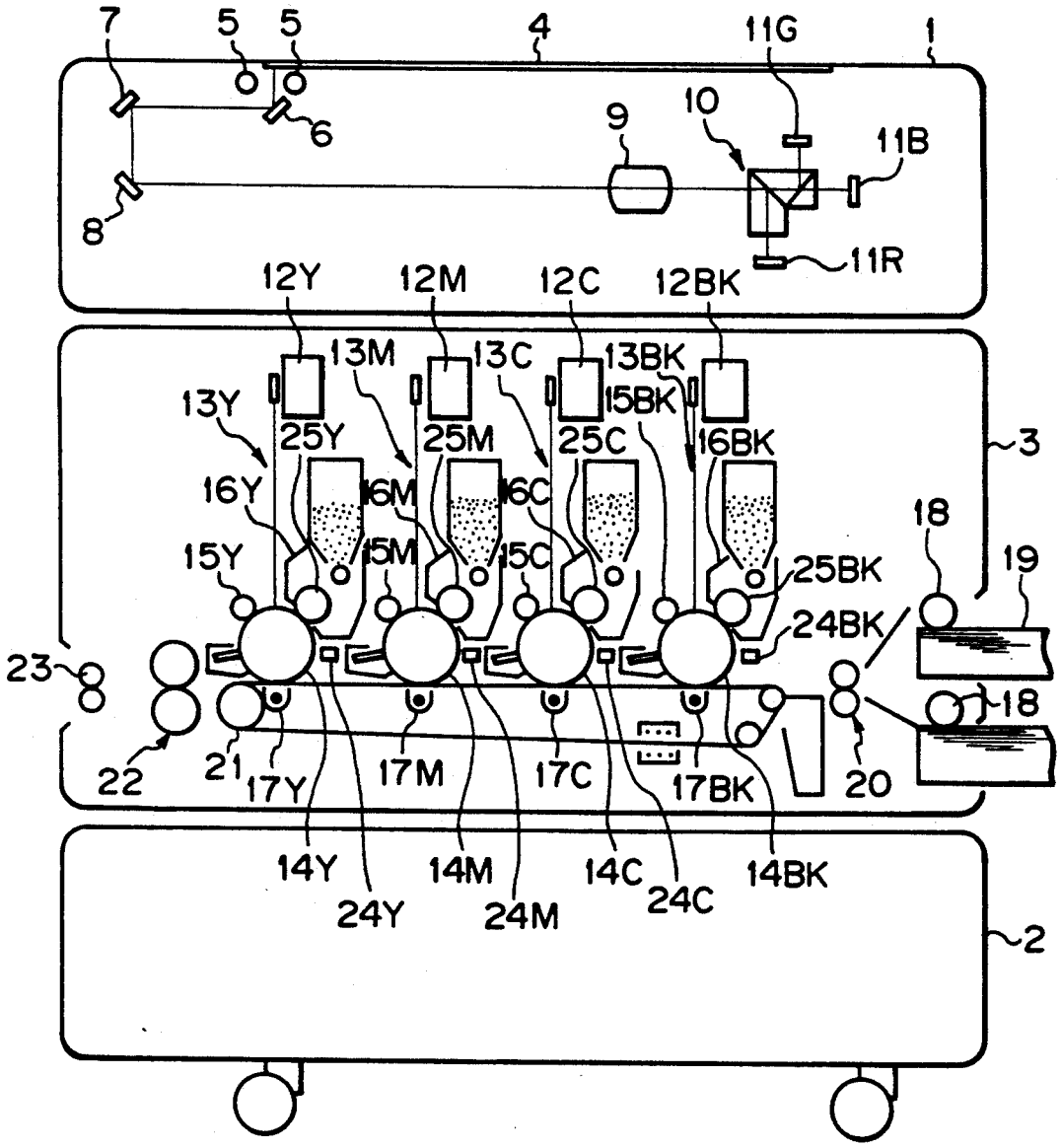
FIG. 6 is a section showing a color copier to which a preferred embodiment of the color image forming equipment in accordance with the present invention is applicable.

A reference will be made to FIGS. 6 through 9 for describing the method which we proposed in previously mentioned U.S. patent application Ser. No. 07/545,508. FIG. 6 schematically shows digital color image forming equipment (color copier) to which the proposed method is applicable. As shown, the equipment is generally made up of a scanner section 1 for scanning a document, an image processing section 2 for electrically processing a digital image signal outputted by the scanning section 1, and a printer section 3 for printing out an image on the basis of color-by-color image recording information outputted by the image processing section 2. The scanner section 1 has a fluorescent lamp or similar lamp 5 for illuminating a document on a glass platen 4. A reflection from the document is incident to a focusing lens 9 via mirrors 6, 7 and 8. The lens 9 focuses the incident light onto a dichroic prism 10 with the result that the light is spectrally separated into three components each having a different wavelength, i.e., red (R), green (G), and blue (B) components. These color components are incident to individual light-sensitive devices such as CCD (Charge Coupled Device) arrays 11R, 11G and 11B and thereby transformed into digital signals. The image processing section 2 effects necessary processing with the outputs of the CCD arrays 11R, 11G and 11B to convert them into recording information of different colors, e.g., black (BK), yellow (Y), magenta (M) and cyan (C) signals.

While the equipment of FIG. 6 is shown as forming a color image in four colors BK, Y, M and C, it may form a color image in only three colors by having one of four recording devices, which will be described, omitted.

The individual color signals from the image processing section 2 are fed to associated laser writing units 12BK, 12C, 12M and 12Y which are incorporated in the printer section 3. In the specific arrangement shown in FIG. 6, four recording devices 13BK, 13C, 13M and 13Y are arranged side by side in the printer section 3. Since all the recording devices 13BK to 13Y have identical structural parts and elements, the following description will concentration on the device 13C adapted for cyan C by way of example. The structural parts and elements of the other recording devices are identical with those of the device 13C and are designated by the same reference numerals with suffixes BK, M and Y.

The recording device 13C has a photoconductive element 14C in the form of a drum, for example, in addition to the laser writing unit 12C. Sequentially arranged around the drum 14C are a main charger, 15C, an exposing position where a laser beam issuing from the laser writing unit 12C will scan the drum 14C, a developing unit 16C, a transfer charger 17C, and so forth. While the main charger 15C uniformly charges the surface of the drum 14C, the laser writing device 12C scans the charged drum surface with a laser beam with the result that a latent image representing a cyan component is electrostatically formed on the drum 14C. Then, the developing unit 16C develops the latent image to produce a toner image. A paper feeding section 19 is implemented as two paper cassettes, for example. A paper sheet fed from either one of the paper cassettes by an associated feed roller 18 is driven to a register roller pair 20 and, at a predetermined timing, driven away from the register roller pair 20 to a transfer belt 21. The transfer belt 21 transports the paper sheet sequentially to the drums 14BK, 14C, 14M and 14Y each carrying a toner image of a particular color thereon. The transfer chargers 17BK through 17Y associated with the drums 14BK–14Y, respectively, transfer such toner images sequentially to the paper sheet. The paper sheet carrying the resultant toner image thereon is driven out of the equipment by a discharge roller pair 23 after having the image fixed thereon. In this instance, the paper sheet is electrostatically retained by the transfer belt 21 and, therefore, transported with accuracy. Reflection type photosensors or P sensors 24BK, 24C, 24M and 24Y are associated with the drums 14BK, 14C, 14M and 14Y, respectively, and each optically senses the amount of toner deposited on a toner image pattern which will be described. The P sensors 24BK–24Y are operable in the same manner as one another with their associated drums 14BK–14Y and, in the following description, they will be represented by the reference numeral 24 without suffix.

In the proposed method described above, sensor pattern forming means forms toner density patterns to be sensed by the P sensor 24 and is also implemented with the charger 15, laser writing unit 12, and developing unit 16. Specifically, the toner image patterns each has a particular image density. Such toner image patterns may be formed by any of some different implementations, as follows. For example, an arrangement may be made such that the quantity of exposing light issuing from the laser writing unit 12 is changed in two steps to form latent image patterns having two different potentials, while the potential of a developing sleeve 25, i.e., a developing bias is maintained constant. Conversely, the quantity of exposing light from the laser writing unit 12 may be maintained constant to form latent images of the same potential (latent image patterns of the same kind), in which case the developing bias of the sleeve 25 will be changed in two steps. Another alternative implementation is to form two latent image patterns having different potentials and developing them by different developing biases. The toner image patterns are not limited to solid images each having a substantial area and may even be dot or line patterns representing desired tones.

Figure 7:
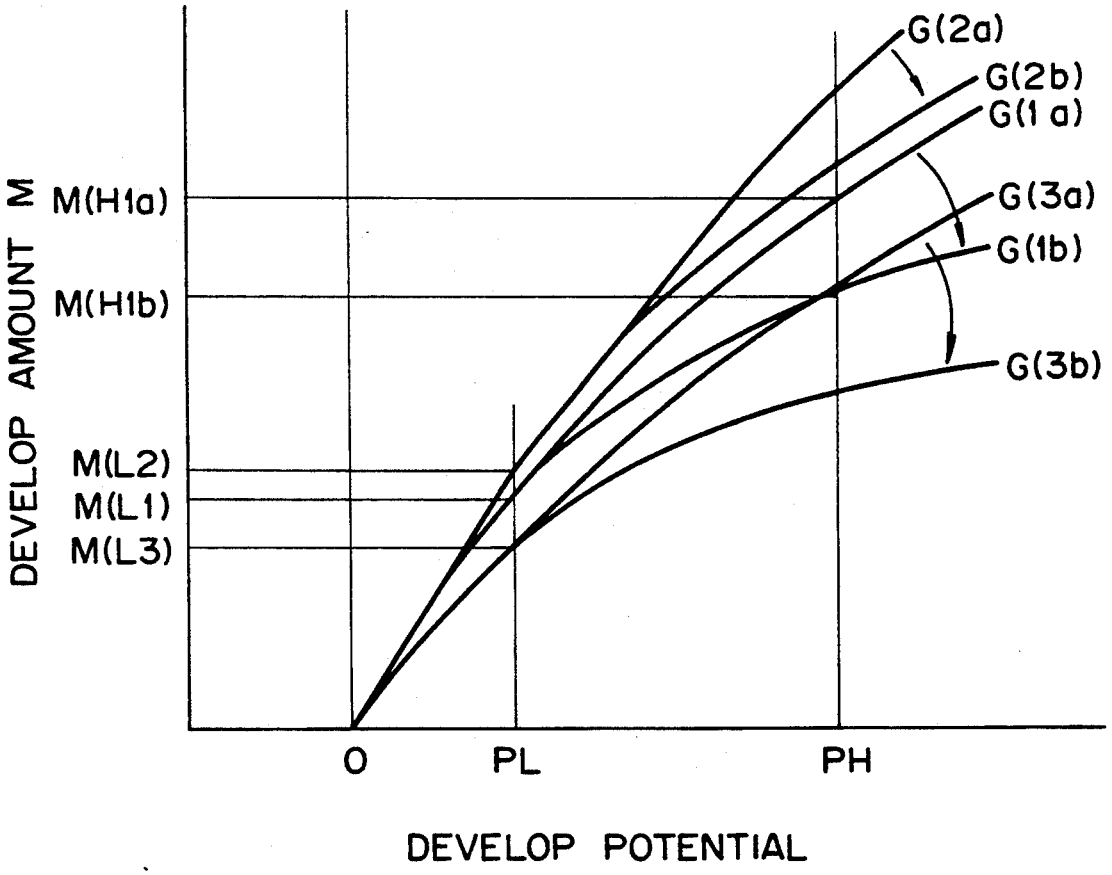
FIG. 7 is a graph showing a developing characteristic in terms of developing amounts and developing potentials of two different patterns.

Assume that the developing potentials of the two latent image patterns ascribable to the differences between the surface potentials and the developing bias are PL and PH (PL<PH), and that, among tones in a range of 0 through 7, tones 3 and 7 are assigned to PL and PH, respectively. Further, assume that when the dynamic range I of a latent image (difference between the maximum and minimum values of the surface potential of a drum formed by a latent image) has a certain value, a developing characteristic G(1*a*) shown in FIG. 7 is the optimal characteristic. Then, the developing amounts of the patterns whose developing potentials are PL and PH are M (L1) and M (H1*a*), respectively. When the toner concentration is increased in the above environment, i.e., at the same time, the developing characteristic is shifted from G (1*a*) to G (2*a*), FIG. 7, causing the developing amounts associated with the developing potentials PH and PH to change to M (L2) and M (H2*a*), respectively. Conversely, a decrease in the toner concentration shifts developing characteristic from G(1*a*) to G(3*a*), FIG. 7, while the developing amounts associated with PL and PH change to M(L3) and M(H3*a*), respectively. With the developing characteristic of FIG. 7, therefore, it is possible to control the toner concentration such that the actual developing characteristic approaches the target characteristic G(1*a*), if the P sensor 24 senses either one of the developing amounts associated with PL and PH. This is the same as the system using a P sensor. In the proposed method, the above control is effected by using the pattern image having the lower developing potential PL.

The above description has concentrated on the same environment and the same time point. How the developing characteristic changes with the environment will be described hereinafter. Assume that the ambient humidity is increased while the developing amount of the pattern associated with the developing potential PL is sensed by the P sensor 24 and controlled to a target value. As shown in FIG. 4, as the ambient humidity increases, toner concentration for maintaining the adequate gamma decreases with the result that, as FIG. 2 indicates, the saturation developing amount increases. Hence, the developing characteristic varies as represented by a curve G(1*b*), FIG. 7, whereby the developing amount M(H1*b*) associated with the developing potential PH is made smaller than the amount associated with usual humidity. It follows that the dynamic range I is adjustable by detecting the difference between M(1*b*) and M(H1*a*).

Figure 8:
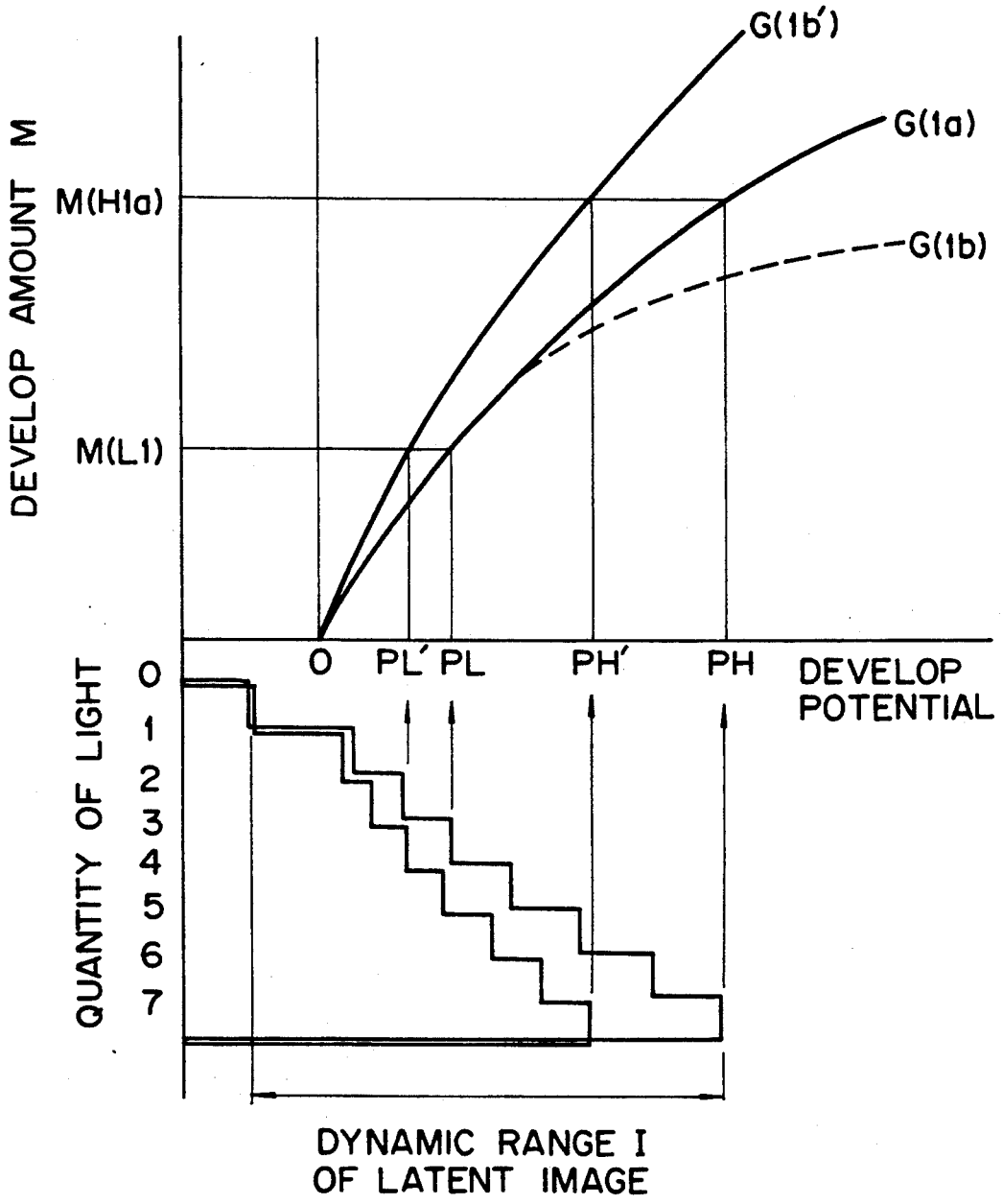
FIG. 8 is a graph indicating how the developing characteristic changes in association with the adjustment of the dynamic range of a latent image.

To facilitate an understanding of the adjustment of the dynamic range I, let it be assumed that the maximum quantity of light of a light image and the developing potential PH are equal to each other, although not necessarily equal in practice. Referring again to FIG. 1, on the change of the developing characteristic from G(1*a*) to G(1*b*), the tone reproducibility is degraded and the maximum amount of toner deposition (=M(H1*b*) is reduced. In the light of this, the dynamic range I of the latent image is reduced with the ratio of the developing potentials PL and PH being held constant. Then, since the toner concentration is so controlled as to maintain M(L1) constant, it sequentially increases with the decrease in developing potential PL→PL' with the result that the curve representative of the developing characteristic rises away from G(1*b*). Such an adjustment is continued until the developing amount M(H1*b*) coincides with the target value M(H1*a*), i.e., until the developing characteristic G(1*b*') holds, on the basis of the output of the P sensor 24 associated with the developing potentials PH-PH'. This is successful in maintaining the developing amount associated with the image signal constant. Therefore, the color copier shown in FIG. 6 is capable of recording halftone in a desired manner. It will be seen that the proposed method is characterized in that when the target developing characteristic G(1*a*), FIG. 8, is changed to G(1*b*) due to the highly humid environment, control is effected to shift the characteristic G(1*a*) to the characteristic G(1*b*').

When the humidity is low, a procedure opposite to the above-stated procedure will be executed. The control described above in relation to humidity is also true with aging. While the proposed method changes the dynamic range by changing the quantity of light issuing from the exposing means 12, the quantity may be replaced with the charging potential of the main charger 15 or may be changed along with the latter.

Figure 9:
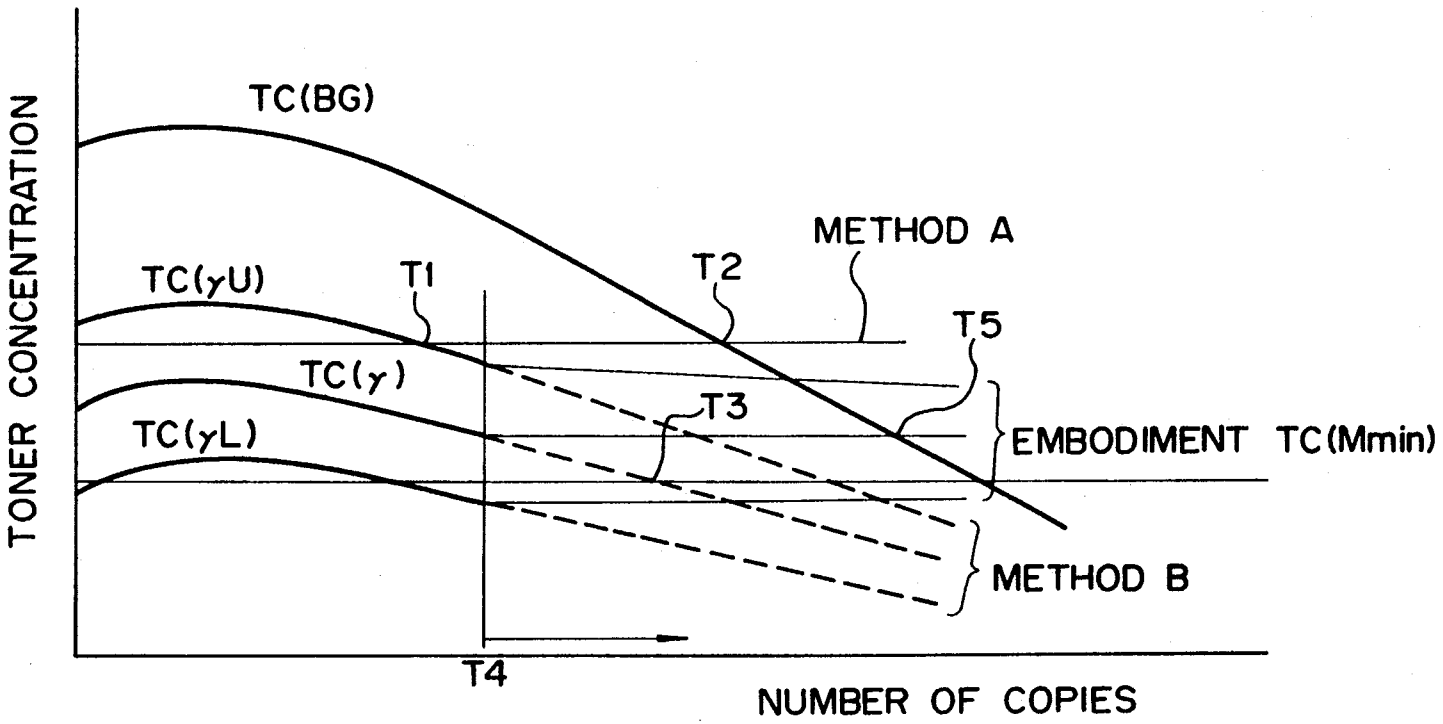
FIG. 9 is a graph comparing an illustrative embodiment of the present invention and the prior art with respect to variation in toner concentration.

FIG. 9 compares the proposed method and the prior art methods A and B with respect to the variation of toner concentration. While the curves of FIG. 9, like those of FIG. 5, pertain to aging as defined by the number of copies produced, they are representative of changes in a high humidity environment II, FIG. 4, as distinguished from the usual humidity environment of FIG. 5. As shown, the method A which controls the toner concentration to a predetermined value fails to achieve high image quality and wastes the developer unless the developer is replaced at a time $T_1$ at which time the toner concentration coincides with the concentration TC (γU). In this connection, some black-and-white printers available today allow the developer to be used until a time $T_2$ at which time the toner concentration coincides with the toner density TC (BG). The method B which controls the developing ability to a predetermined one determines that the life of the developer has expired at a time $T_3$ at which time the toner concentration TC (γ) coincides with TC (Mmin), requiring the developer to be replaced, as indicated by dotted lines in the figure. In contrast, with the proposed method which controls the toner concentration TC (γ) constant while preventing it from decreasing beyond the initial value, it is possible to use the developer until the toner concentration TC (BG) reaches the target concentration TC (γ) at a time $T_5$. Concerning the proposed method, FIG. 9 indicates a case wherein the dynamic range is sequentially reduced from the time $T_4$. The curves of FIG. 9 show that the proposed method is capable of insuring high image quality over a long period of time and extends the life of the developer, compared to the prior art methods.

Figure 10:
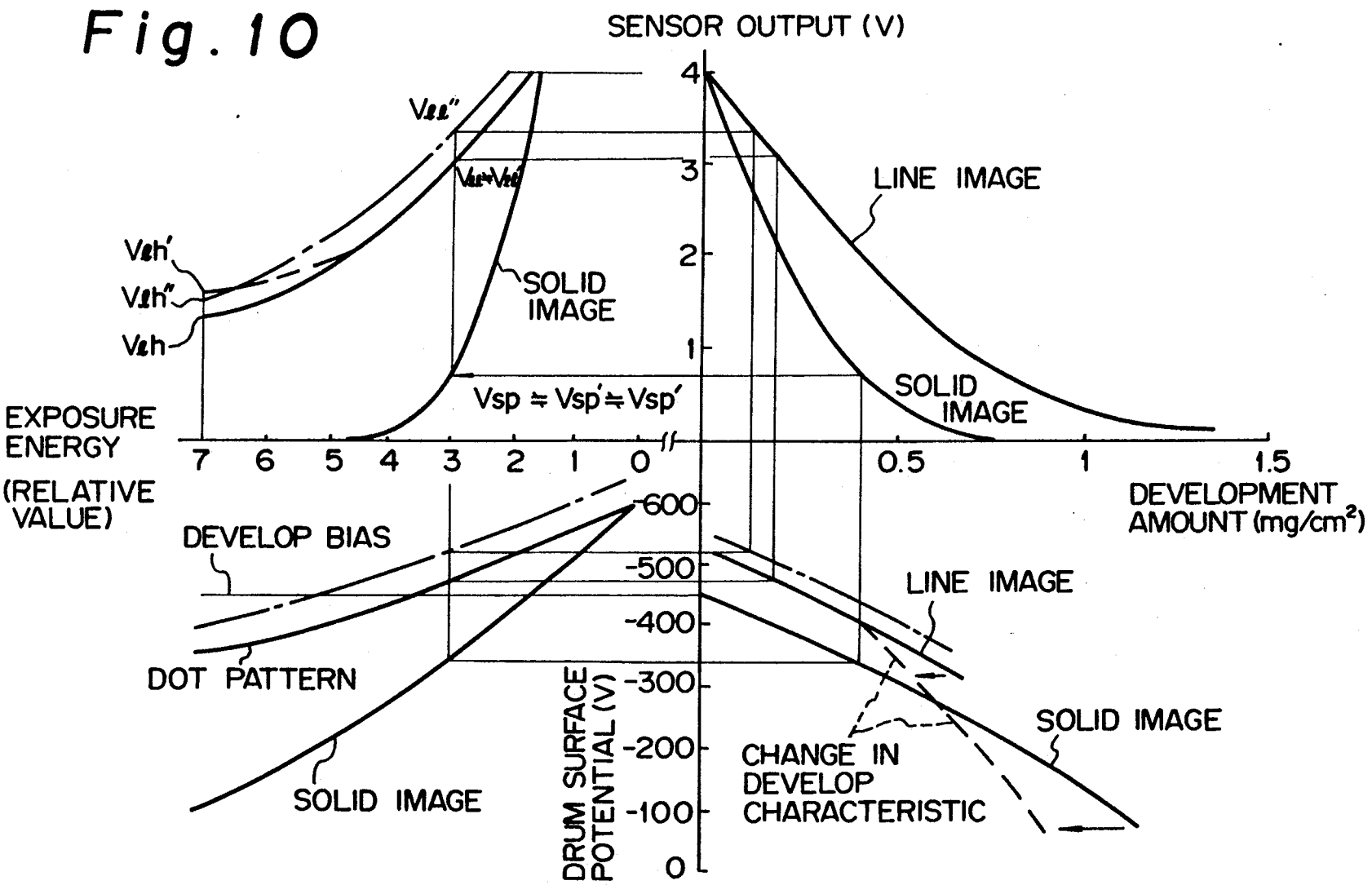
FIG. 10 is a graph indicating the response characteristic of a photosensor.
Figure 11:
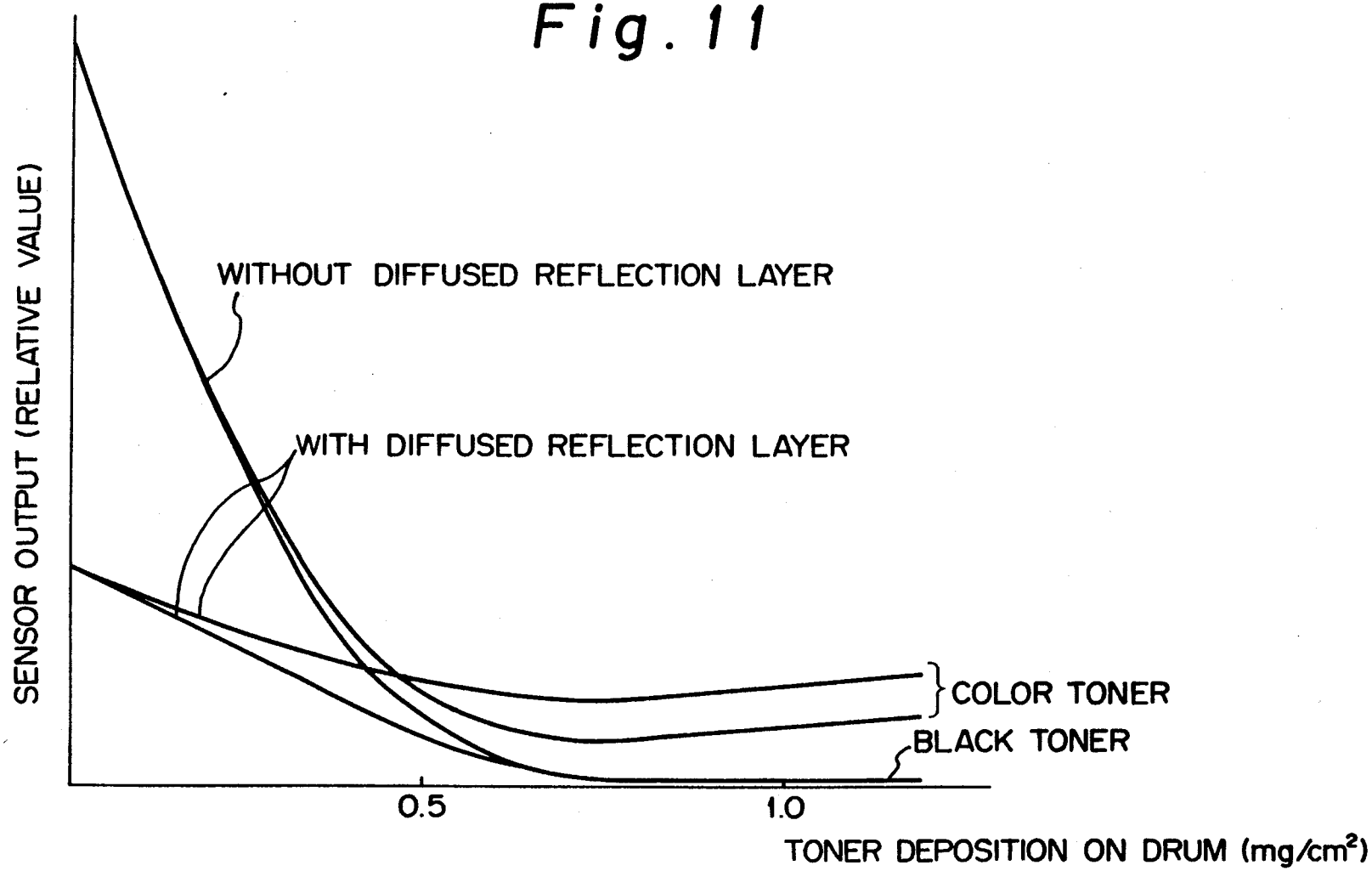
FIG. 11 is a graph indicating the change in the characteristic of a photosensor ascribable to the amount of toner deposition.
Figure 12:
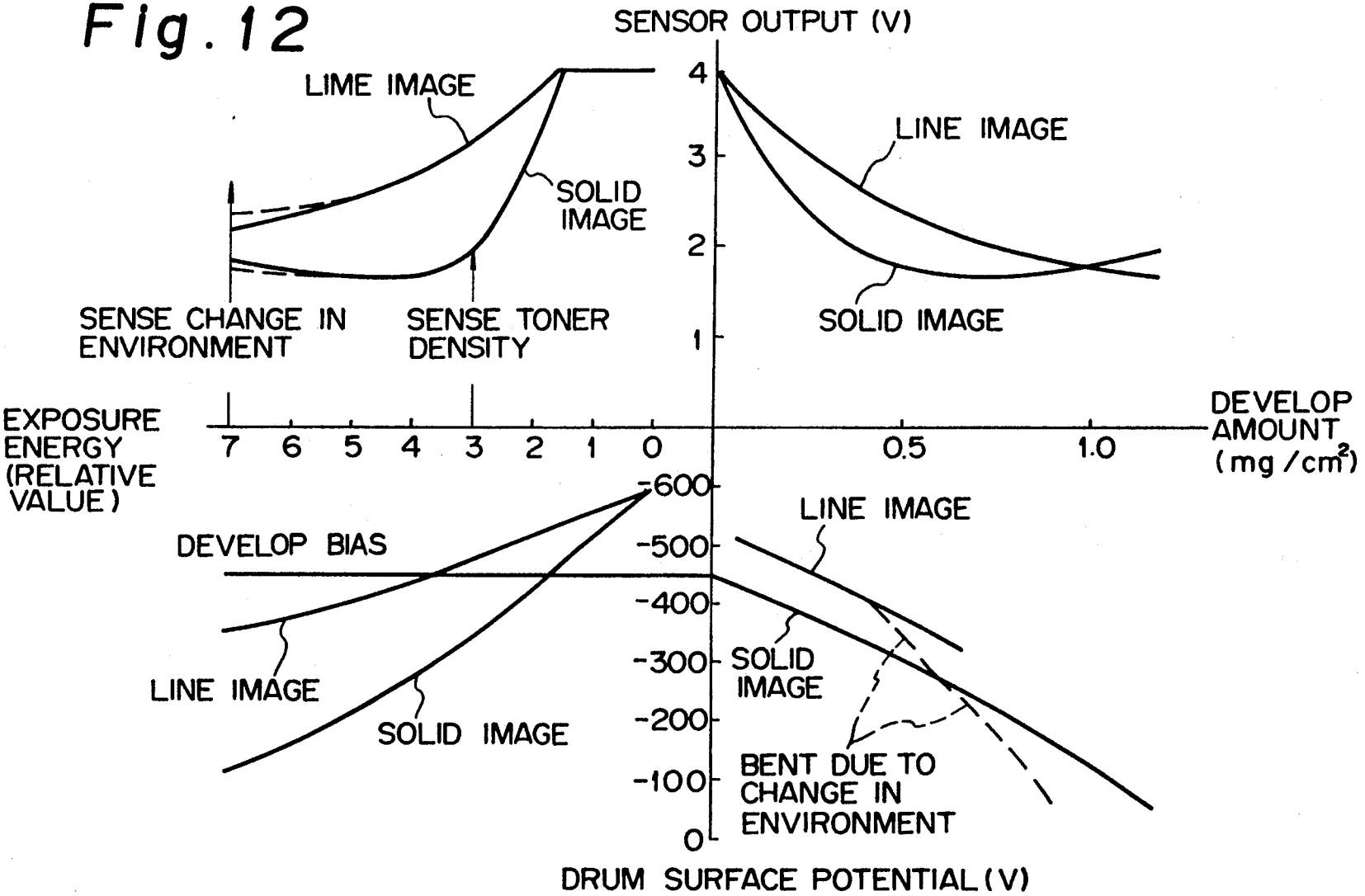
FIG. 12 is a graph showing the response characteristic of a photosensor in relation to a color toner.

Referring to FIGS. 10 through 12, the method we proposed in Japanese Patent Application No. 238107/1989 will be described. In the figures, the same parts and elements as those shown in FIGS. 1 through 9 are designated by the same reference numerals, and redundant description will be avoided for simplicity. This proposed method constitutes an improvement over the previously described proposed method of ours. Specifically, by using the fact that the response characteristic of the P sensor 24 differs from a solid toner pattern having a substantial area to a line toner image, the proposed method which will be described grasps the change in developing characteristic with accuracy.

The background art of the proposed method will be described first. The developing characteristic is hard to grasp accuratey when the maximum developing amount Mmax should be such that one or more toner layers cover the surface of a photoconductive element. This is because, as shown in FIG. 11, the sensing characteristic of the P sensor 24 is substantially saturated when the toner is deposited in one layer on a photoconductive element (0.5 mg/cm$^2$), and the sensitivity is almost zero when it comes to two or more toner layers. More specifically, since the P sensor 24 is responsive to the quantity of light (ratio) by which a reflection from the surface of a photoconductive element is intercepted by the toner deposition, the sensing range is just up to the instant when the toner covers the surface of a photoconductive element in one layer.

The condition wherein the toner cannot sufficiently absorb the light from the P sensor 24 such as when the toner is a color toner is another problem. The absorption ratio of a color toner is less than 30% for the light of 900 and several nm which is the detectable range of the P sensor 24. Specifically, since a diffused reflection from a color toner increases with the amount of toner deposition, there exists a range wherein, as shown in FIG. 11, the quantity of sensed light (reflection) increases with the increase in the amount of toner deposition (slightly rising to the right).

Moreover, the condition wherein a photoconductive element has a layer which diffuses or absorbs more than one half of the light from the P sensor 24 is another problem. Actually, some photoconductive elements for use with laser printers are provided with a layer for diffused reflection in order to prevent a laser beam from being reflected multiple times between the surface of the photoconductive element and the substrate to form an interference pattern. Then, the quantity of reflection from the photoconductive element is reduced, compared to the quantity of diffused reflection from the toner. As a result, the signal-to-noise (S/N) radio is lowered to aggravate erroneous detection, as represented by "WITH DIFFUSED REFLECTION LAYER" in FIG. 11.

In light of the above, our proposed method which will be described uses at least two different kinds of toner image patterns including a solid image having a substantial area and an image other than a solid image, i.e., a line image. Here, assume three different kinds of toner image patterns, i.e., a solid image pattern having a medium density (P sensor output Vsp), a line image pattern having a medium density (P sensor output Vl), and a line image pattern having the maximum density (P sensor output Vlh). Assuming a given constant Vspo, the toner is supplied when the value Vsp measured with the solid image pattern is smaller than the constant Vspo or not supplied when the former is greater than the latter.

The control over the image forming conditions particular to the proposed method is as follows. Table 1 shown below lists charge potentials Vo, developing bias voltages Vb, potentials Vp of a toner image pattern portion, and toner control constants Vspo which are stored in a memory together with pointers P.

TABLE 1

| POINTER P | VO | Vb | Vl | VO − Vb |
|---|---|---|---|---|
| 0 | 363 | 278 | 188 | 75 |
| 1 | 369 | 290 | 196 | 78 |
| 2 | 384 | 306 | 208 | 78 |
| 3 | 400 | 318 | 216 | 82 |
| 4 | 416 | 329 | 224 | 86 |
| 5 | 431 | 345 | 235 | 86 |
| 6 | 447 | 357 | 243 | 90 |
| 7 | 463 | 369 | 255 | 94 |
| 8 | 478 | 380 | 263 | 98 |
| 9 | 494 | 396 | 275 | 98 |
| 10 | 510 | 408 | 282 | 102 |
| 11 | 525 | 420 | 294 | 106 |
| 12 | 541 | 431 | 302 | 110 |
| 13 | 557 | 447 | 314 | 110 |
| 14 | 573 | 459 | 322 | 114 |
| 15 | 588 | 471 | 329 | 118 |
| 16 | 604 | 486 | 341 | 118 |
| 17 | 620 | 498 | 349 | 122 |
| 18 | 635 | 510 | 361 | 125 |
| 19 | 651 | 522 | 369 | 129 |
| 20 | 667 | 537 | 380 | 129 |
| 21 | 682 | 549 | 388 | 133 |
| 22 | 698 | 561 | 396 | 137 |
| 23 | 714 | 576 | 408 | 137 |
| 24 | 729 | 588 | 416 | 141 |
| 25 | 745 | 600 | 427 | 145 |
| 26 | 761 | 612 | 435 | 149 |
| 27 | 776 | 627 | 447 | 149 |
| 28 | 792 | 639 | 455 | 153 |
| 29 | 808 | 651 | 463 | 157 |
| 30 | 824 | 667 | 475 | 157 |
| 31 | 839 | 678 | 482 | 161 |

The control is effected by using Table 1 and the target value Vdo of Vll−Vlh, the lower limit $P_1$ of pointer, the upper limit $P_2$ of pointer, a given constant Po which is greater than $P_1$ and smaller than $P_2$, the increment or decrement Di (=0, 1, 2) of pointer ($D_0<D_1<D_2$), a constant Vdn for determining the unvariable range of pointer, and the running mean Vda of the differences between measured values Vll and Vlh.

TABLE 2

| POINTER P OF CONDITION TABLE STORED IN MEMORY | POINTER P OF CONDITION TABLE (CONDITION FOR NEXT IMAGE FORMING) | | | |
|---|---|---|---|---|
| DECREASE←DYNAMIC RANGE→INCREASE | | | | |
| $P = P_2$ | DECREASE BY D2 | DECREASE BY D0 | NO CHANGE | NO CHANGE |
| $P_0 < P < P_1$ | DECREASE BY D2 | DECREASE BY D0 | NO CHANGE | INCREASE BY D1 |
| $P = P_0$ | DECREASE BY D0 | NO CHANGE | NO CHANGE | INCREASE BY D1 |
| $P_1 > P > P_0$ | DECREASE BY D1 | NO CHANGE | INCREASE BY D0 | INCREASE BY D2 |
| $P = P_1$ | NO CHANGE | NO CHANGE | INCREASE BY D0 | INCREASE BY D2 |
| ESTIMATED CURRENT DYNAMIC RANGE VS. PROPER ONE BASED ON Vda | BROAD | SOMEWHAT BROAD OR ADEQUATE | SOMEWHAT NARROW OR ADEQUATE | NARROW |
| RUNNING MEAN Vda OF (Vll − Vlh) (MEASURED) | Vda < Vdo − Vdn | Vdo − Vdn ≦ Vda < Vdo | Vdo ≦ Vda < Vdo − Vdn | Vdo − Vdn ≦ Vda |

It is to be noted that while the toner supply control is effected every time a copying cycle is completed, the control over the image forming conditions is effected when a copy button is pressed again after a sequence of copying operations.

FIG. 10 is indicative of the response characteristic of the P sensor 24 particular to the proposed method with respect to a relation between the developing amount and the P sensor output, a relation between the exposing energy and the P sensor output, a relation between the exposing energy and the surface potential of a photoconductive element, and a relation between the developing amount and the surface potential. The characteristic of FIG. 10 was determined with a black toner. Regarding a solid image pattern, the developing amount is dependent only on the developing ability of a developer (=amount of charge Q/M of toner) and the developing potential (=difference between pattern potential and developing bias). Hence, with a solid image pattern, it is possible to readily grasp the developing ability of a developer only if the developing potential is maintained constant. More specifically, the P sensor output associated with the solid image pattern having a medium density is Vsp≈Vsp". However, the problem is that the P sensor sensitivity decreases to zero when the amount of toner deposition is great (black toner; Vsp≈Vsp', FIG. 10); in the worst case, the sensitivity is reversed (the sensor output increases with the increase in the amount of toner deposition), as shown in FIG. 12 corresponding to FIG. 10.

On the other hand, an advantage particular to a line image pattern is that even when the amount of toner deposition is great, Vlh is not equal to Vlh' and, therefore, the sensitivity of the P sensor 24 is insured. However, the problem with a line image pattern is that the absolute value of the sensor output is not fully reliable since the developing amount changes (Vll≠Vll" or Vlh≠Vlh) with the background potential (=difference between background potential and developing bias) and the quality of the latent image of the line image pattern in addition to the developing potential. The quality of the latent image includes the focus and flare in the case of analog, the spread of a laser spot and the ringing of rise and fall of ON and OFF in the case of digital laser writing, or the amount by which the light is intercepted, the open/close speed, the restriction of a beam and the flare light in the case of a liquid crystal shutter scheme.

In light of the above, our proposed method uses the advantages particular to the sensor response characteristics derived from a solid image and a line image in grasping the change in developing characteristic with accuracy, as shown in Table 2. The toner density and dynamic range are variably controlled on the basis of the change in developing characteristic. Specifically, when the relative value of exposing energy is "7" which causes a great amount of toner to deposit, changes in ambient conditions are sensed on the basis of the sensed output Vlh associated with the line image pattern having the maximum density. When the relative value of exposing energy is "3", the toner density is sensed on the basis of the solid image pattern and line image pattern each having a medium density. This kind of control will be referred to as DIF control hereinafter.

Referring to FIGS. 13–20, 21A, 21B, 22, 23A, 23B, 24A, 24B and 25, color image forming equipment embodying the present invention will be described which prevents the toner concentration from running out of control when the background potential of a photoconductive element is erroneously sensed and can detect an error which may occur in an image forming system including a photoconductive element.

Figure 13:
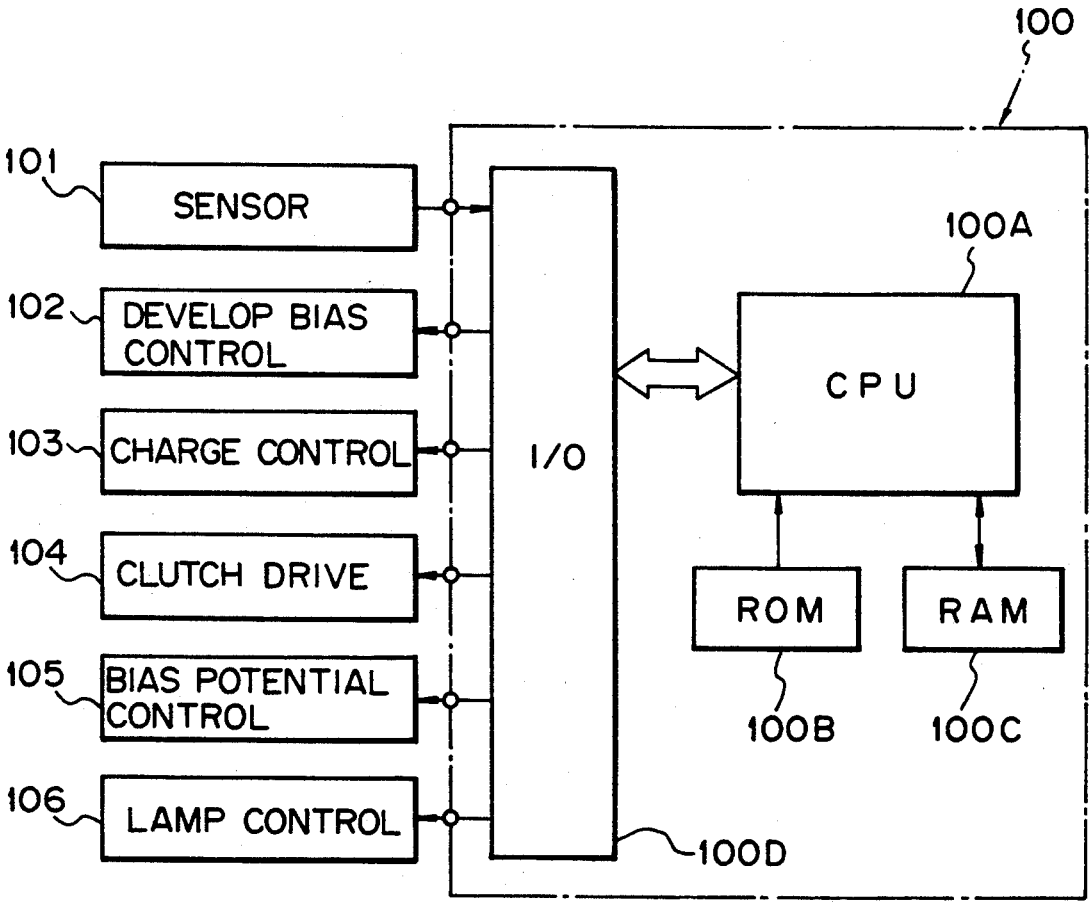
FIG. 13 is a block diagram schematically showing a control section included in the embodiment of the present invention.

As shown in FIG. 13, a control section included in the embodiment is shown. As shown, the control section, generally 100, has a microcomputer (CPU) 100A to which a ROM 100B and a RAM 100C are connected. The ROM 100B stores basic programs for executing arithmetic and control processing as well as basic data for such processing. An external arrangement is connected to the RAM 100C via an I/O interface 100D. Specifically, a photosensor 101 is connected to the input side of the I/O interface 100D and representative of the sensors 24BK, 24C, 24M and 24Y, FIG. 6. Comprising a light emitting element and a light-sensitive element, the photosensor 101 is responsive to the amount of toner deposition on a pattern formed on a photoconductive element, i.e., a toner concentration TC. Connected to the output side of the I/O interface 100D are a developing bias control unit 102, a charge control unit 103, a clutch driver 104 associated with a toner supply section, a bias potential control unit 105 also associated with the toner supply section, and a lamp control unit 106 for exposure. The developing bias unit 102 of the external arrangement plays the role of a driver for setting the bias potential of a toner on a developing sleeve. The charge control unit 103 serves as a driver for setting the charge potential of the background of a photoconuctive element. The clutch driver 104 drives a clutch associated with a paddle when the density of the developed pattern on a photoconductive element (i.e. density Vsp of solid image pattern) is related with a given constant Vspo as $Vsp \times 1/Vsg+ > Vspo$ (when $Vsg+ > Vsg$) or when $Vsp \times 4/Vsg > Vspo$ (when $Vsg+ < Vsg$). The bias potential control unit 105 sets up a potential when a bias is to be applied to the toner. Further, the lamp control unit 108 controls the quantity of light to issue from a lamp.

Figure 14A:
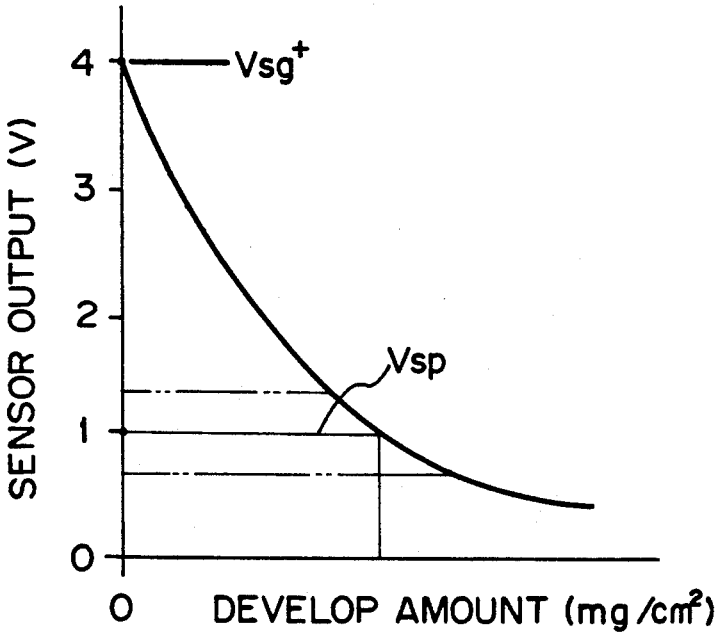
FIG. 14A is a graph showing a relation between the output of a photosensor and the amount of toner deposition.

The CPU 100A controls toner supply on the basis of the background potential detected when the developing sleeve was in a halt state and the photoconductive element was in movement (Vsg+) and the background voltage of the photoconductive element detected when both of the photoconductive element and developing sleeve were in operation (Vsg). Specifically, as shown in FIG. 14A, while the background voltage sensed by an optical sensor changes with the amount of toner deposited on the background of a photoconductive element, it is usually set at 4 V when no toner is deposited. As a toner image pattern is formed on a photoconductive element with such a background voltage used as a reference, the toner concentration of the toner image is sensed to control the toner concentration on the photoconductive element. The illustrative embodiment controls the toner concentration of the toner image pattern over a predetermined range whose reference is 1 V.

Figure 14B:
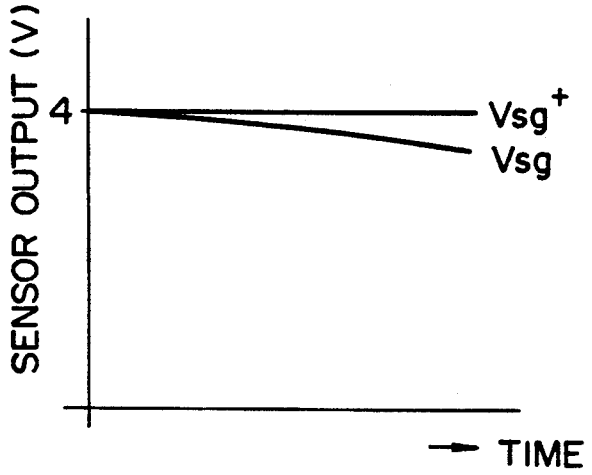
FIG. 14B is a graph showing the change in the output of a photosensor due to aging.

As shown in FIG. 14B, the background potential is lower when the developing sleeve is in movement (Vsg) than when it is in a halt (Vsg+) due to the deposition of a toner. However, when a photoconductive element is not fully cleaned after an image forming operation or when the set toner concentration is unusually high, a greater amount of toner remains on the photoconductive element to lower the background voltage Vsg+, as discussed earlier. In such a case, the embodiment executes toner concentration control and dynamic range control by using the background voltage detected when the developing sleeve was in operation, i.e., the reference voltage.

Figure 15:
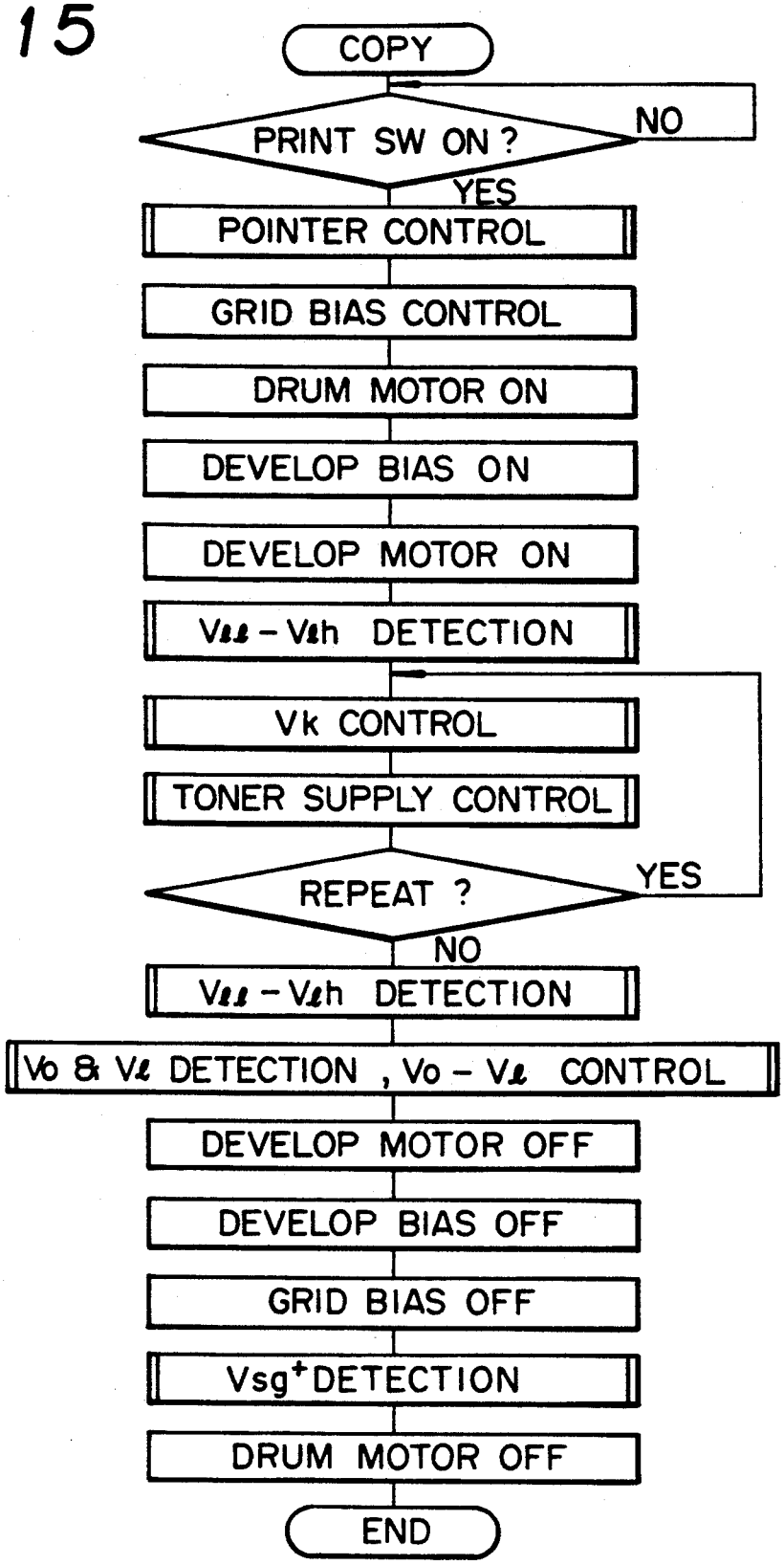
FIG. 15–20, 21A, 21B, 22, 23A, 23B, 24A, 24B and 25 are flowcharts demonstrating a specific operation of the control section depicted in FIG. 13.
Figure 16:
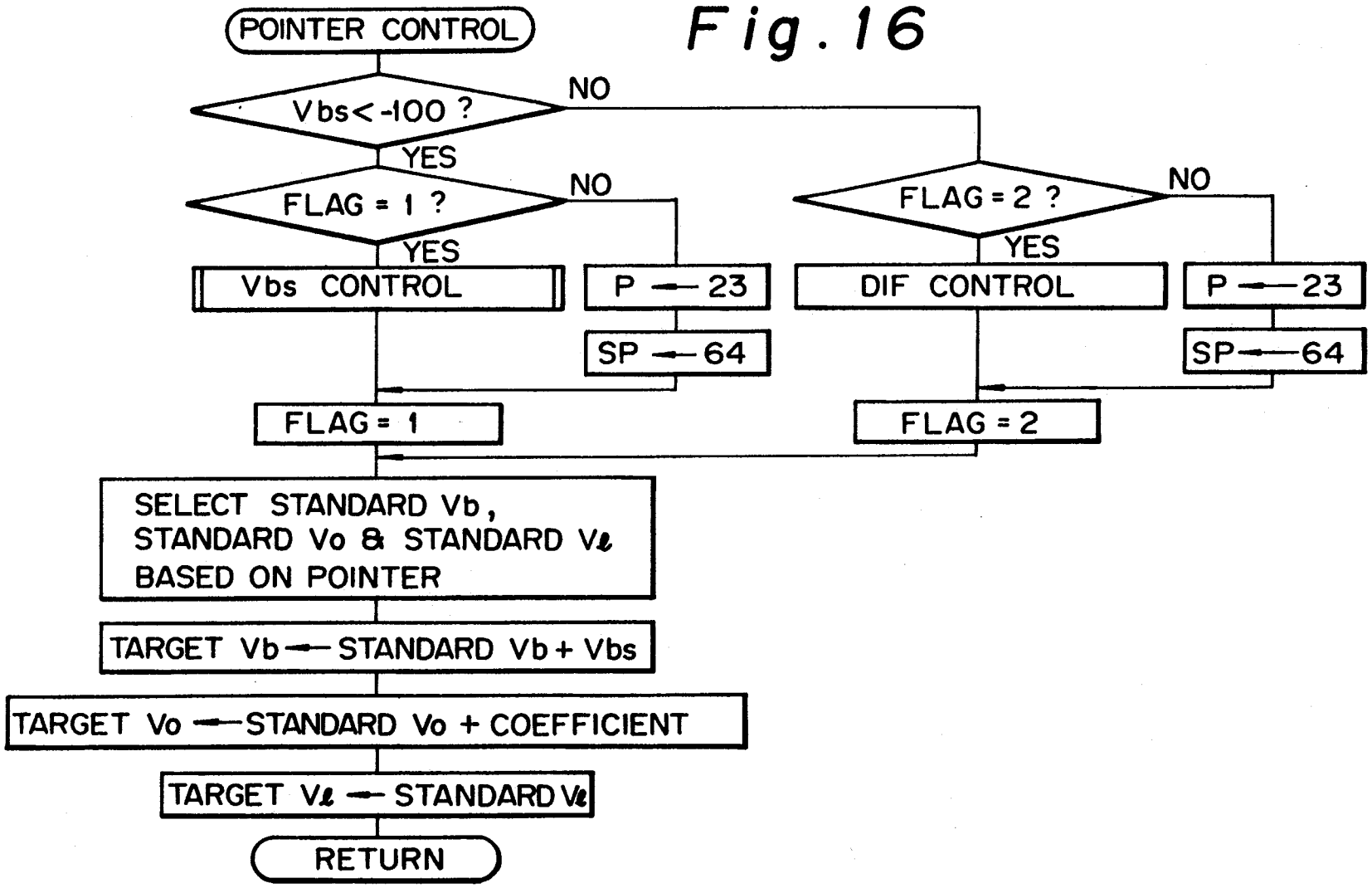

FIG. 15 is representative of sequence control meant for the operations of the entire copier. As shown, the procedure begins with a step of determining whether or not a copy start switch or print start switch has been turned on. If the answer of this step is positive, the CPU 100A sets the background potential of the photoconductive element by pointer control which will be described. As shown in FIG. 16, in the pointer control, the CPU 100A determines whether or not the shift Vbs of the developing bias is smaller than a predetermined value and, if the answer is positive, determines whether or no a flag representative of such a state has been set. If the flag of interest has been set, the CPU 100A executes Vbs control. If the flag has not been set, the CPU 100A fixes the pointer for dynamic range which is based on the DIF control at pointer #23 (Table 3 shown below)

TABLE 3

| | BELOW DIF0 − α | DIF0 − α DIF0 | DIF DIF0 + α | ABOVE DIF |
|---|---|---|---|---|
| 0 | 0 | 0 | 1 | 4 |
| 1 | −4 | −1 | 1 | 4 |
| . | | | | |
| . | | | | |
| . | | | | |
| 22 | | | | |
| 23 | −4 | −1 | 0 | 0 |

In Table 3, α is 0.32 V in the case of black development or 0.16 V in the case of color development.

Subsequently, the CPU 100A fixes the subpointer shown in Table 4 at pointer #64.

TABLE 4

| Vbs | −104 (23) | −112 (24) | −120 (25) | −128 (26) | −136 (27) | −140 (28) | −152 (29) | −160 (30) | −168 (31) |
|---|---|---|---|---|---|---|---|---|---|
| 23 | 0 | +4 | +16 | +32 | +64 | +128 | +128 | +128 | +128 |
| 24 | −4 | 0 | +4 | +16 | +32 | +64 | +128 | +128 | +128 |
| 25 | −16 | −4 | 0 | +4 | +16 | +32 | +64 | +128 | +128 |
| 26 | −32 | −16 | −4 | 0 | −4 | +16 | +32 | +64 | +128 |
| 27 | −64 | −32 | −16 | −4 | 0 | +4 | +16 | +32 | +64 |
| 28 | −128 | −64 | −32 | −16 | −4 | 0 | +4 | +16 | +32 |
| 29 | −128 | −128 | −64 | −32 | −16 | −4 | 0 | +4 | +16 |
| 30 | −128 | −128 | −128 | −64 | −32 | −16 | −4 | 0 | +4 |
| 31 | −128 | −128 | −128 | −128 | −64 | −32 | −16 | −4 | 0 |

Figure 17:
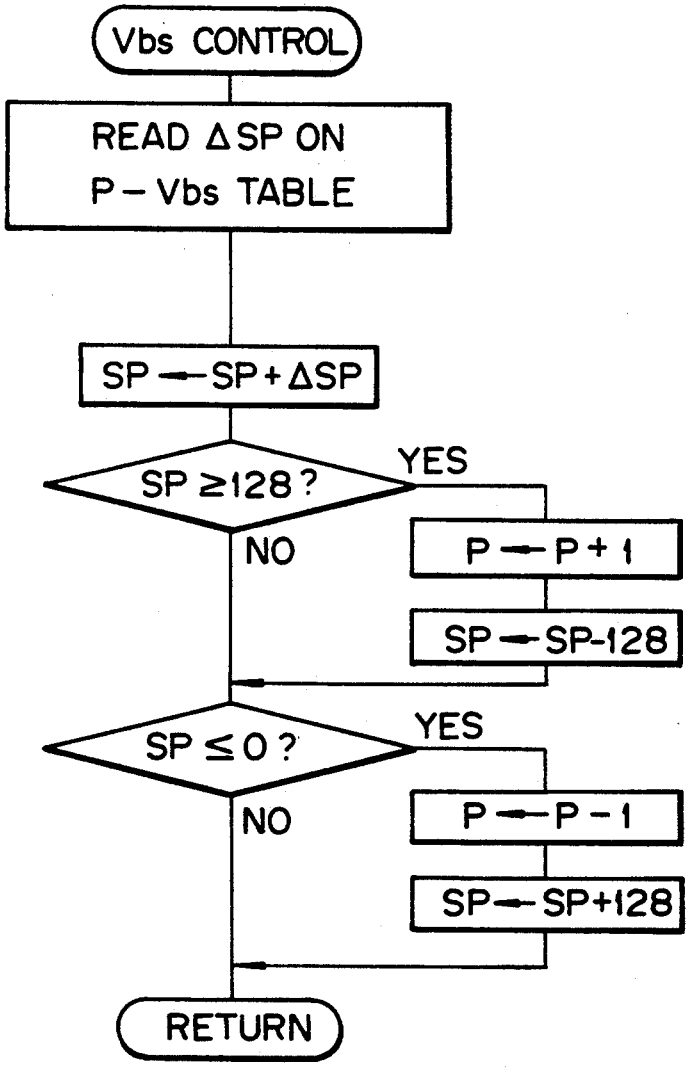

As shown in FIG. 17, in the Vbs control, the CPU 100A selects ΔSP in a pointer (P)−Vbs table and determines whether or not the subpointer is greater than or equal to "128". Based on the result of decision, the CPU 100A updates the pointer and subpointer. Then, the CPU 100A determines whether or not the subpointer is smaller than or equal to zero and, if the answer is positive, selects a pointer one step lower than the existing pointer while updating the subpointer accordingly. Assume that the developing bias is shifted in the event when the first copy is to be executed. Then, in the Vbs control, the embodiment sets the shift in the range of, for example, 20 V by neglecting the range of, for example, 8 V which is usually the limit of shift, thereby reducing the time necessary for the toner to reach a predetermined concentration.

Figure 18:
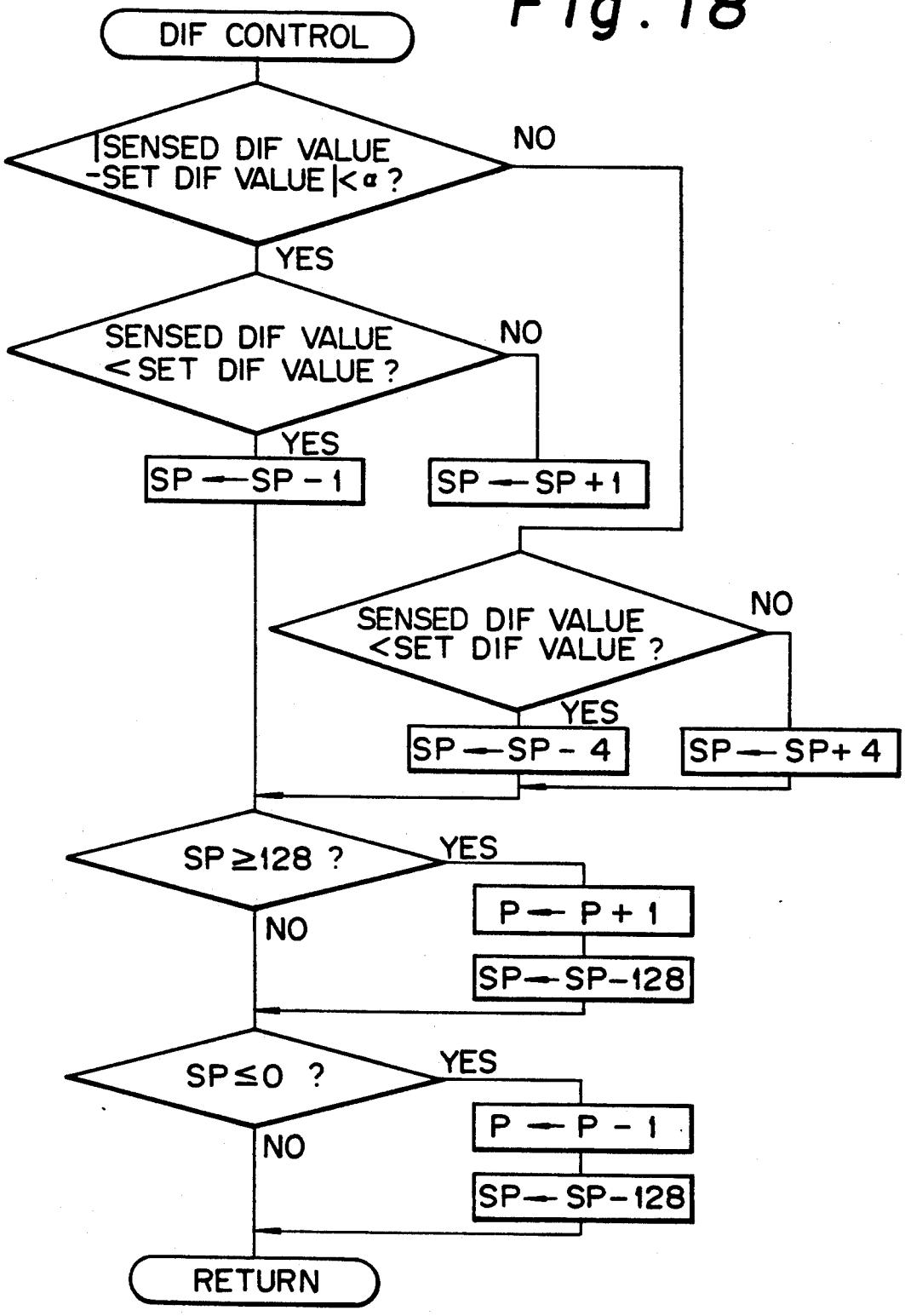

On the other hand, when the shift Vbs of the developing bias is not smaller than the predetermined value, the CPU 100A determines whether or not a flag representative of such a state has been set. If the answer of this decision is positive, the CPU 100A executes the DIF control; if otherwise, the CPU 100A fixes the pointer and subpointer as in the above-stated Vbs control. As shown in FIG. 18, in the DIF control, the CPU 100A produces a difference α between a detected DIF value resulted from the previously stated Vll−Vlh and a set DIF value. Then, the CPU 100A determines whether or not the difference $\alpha$ is smaller than 0.24 V in the case of black development or smaller than 0.12 V in the case of color development. If the answer is positive, the CPU 100A determines which of the detected value and the set value is greater than the other and, based on the resulted relation, carries down or carries up the subpointer. This is also true when the answer of the decision on the above-mentioned difference is negative. Then, the CPU 100A corrects the pointer and subpointer by determining whether the updated subpointer is smaller or greater than "128".

Figure 19:
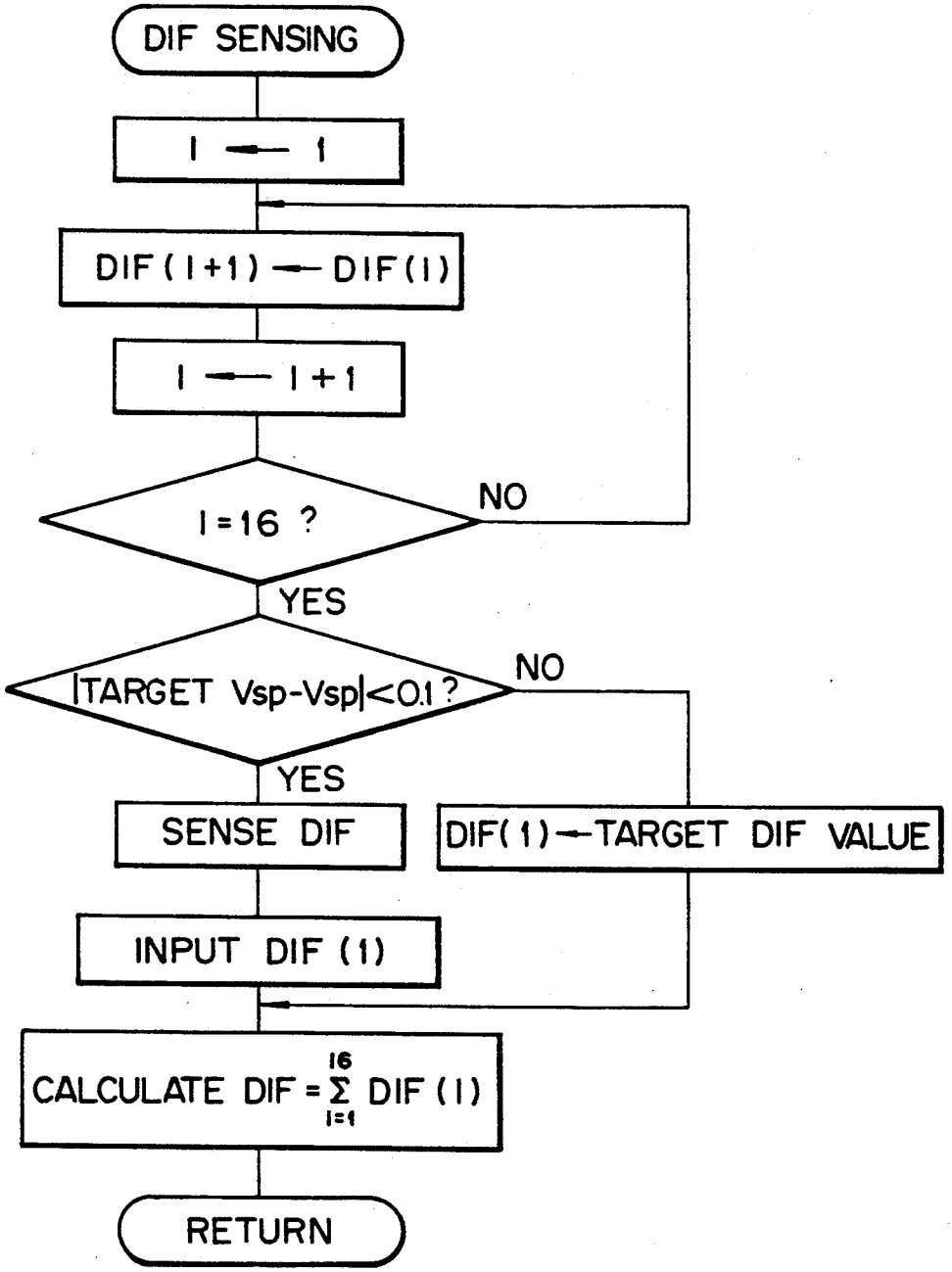

As shown in FIG. 19, DIF detection in the above-stated DIF control consists in setting past DIF data, updating the above-mentioned Vll−Vlh, updating the initial value, determining whether or not the detection has completed with all of the tones, producing, if the answer is positive, a difference between the detected value associated with the toner pattern and the target value, and determining a relation between the difference and the predetermined value. If the difference is smaller than the predetermined value, the CPU 100A inputs the data determining that DIF detection has completed, sums the output data, and then uses the sum to set a pointer for DIF control.

Figure 20:
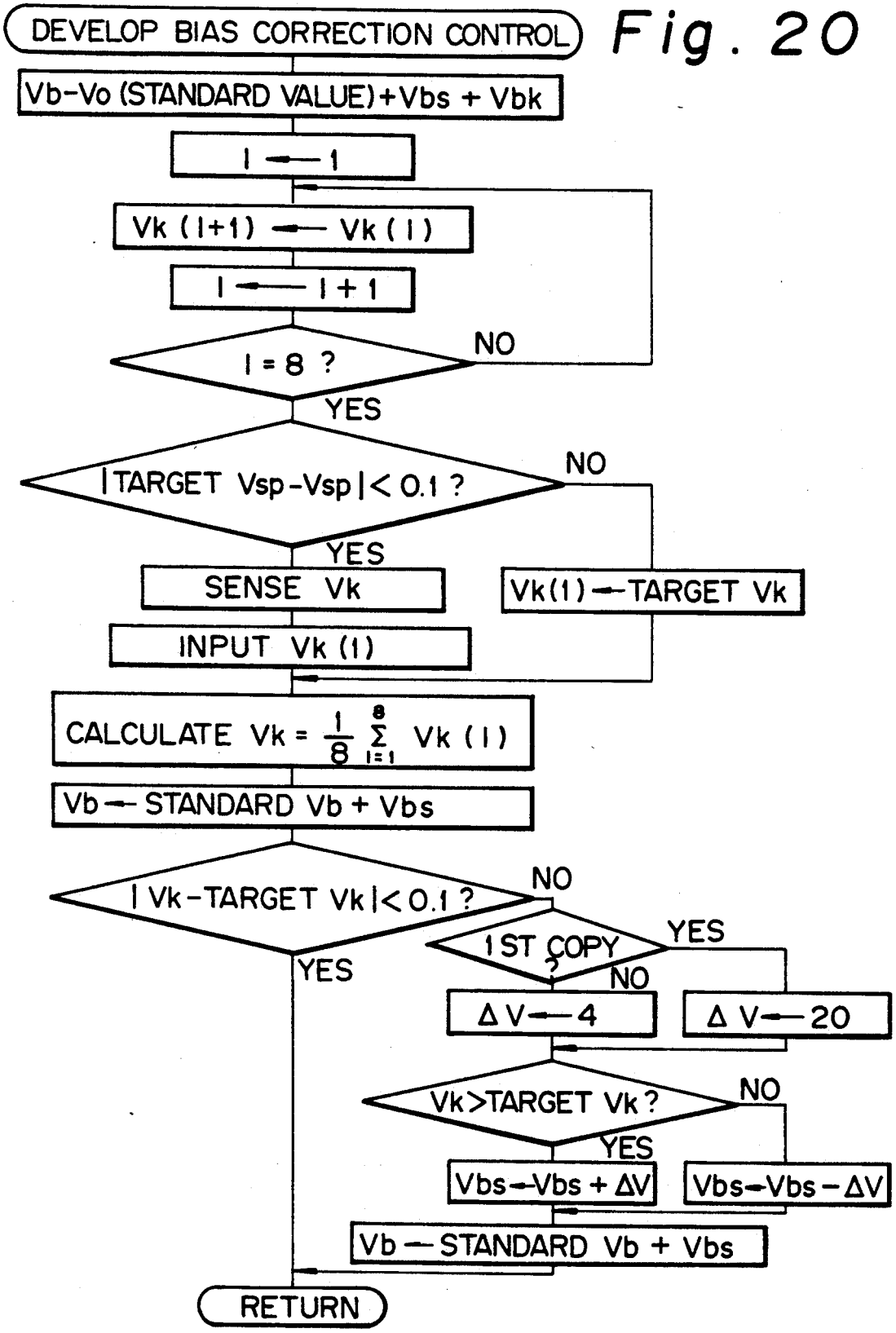

After the CPU 100A has determined a shift of developing bias by the Vbs control or a correction amount of charge potential by the DIF control, it selects a standard developing bias, a standard charge potential and a standard amount of exposure in a pointer table, FIG. 16. Then, the CPU 100A corrects the standard values to effective values. Subsequently, the charger and the drive section associated with the developing sleeve are turned on while, at the same time, the photoconductive element is driven to form an image thereon. The photosensor senses the density of the resultant toner pattern on the photoconductive element to allow the developing bias to be corrected. Specifically, so-called Vk control is executed, as shown in FIG. 20.

The Vk control shifts the developing bias Vb such that the output Vk of the photosensor (potential sensed when the potential is low) remains constant. The illustrative embodiment considers the shift Vbs as as a difference between the effective developing bias and the output developing bias and adds it to a developing bias at the time of actual image forming operation. More specifically, the embodiment considers the developing bias Vb as a sum of the developing bias Vb (target value) and the value Vbs for cancelling the difference between the bias Vb (target value) and the effective developing bias. A shift of the developing bias with respect to the background potential Vo of the photoconductive drum is produced by:

$$Vb = Vb\ (\text{target value}) + Vbs \quad (1)$$

$$Vb\ (\text{target value}) = Vo + Vbk \quad (2)$$

$$Vb = Vo + Vbk + Vbs \quad (3)$$

where Vbk is equal to the image forming potential Vk (e.g. 24 V).

Assuming that the photosensor output under the above condition is Vk, shifting Vb such that the photosensor output Vk reaches a target value Vko thereof is successful in determining a deviation of the effective developing bias, i.e., an optimal shift.

In this embodiment, the running mean of eight Vk's is produced and compared with Vko. When the difference between the resulted mean Vk and Vko is less than 0.1 V (or 0.2 V in the case of black development), the Vk control is not effected in order to reduce the influence of the irregularity of charge:

$$|Vk - Vko| < 0.1\ V \quad (4)$$

More specifically, assume that the target potential of the control image pattern portion with a toner concentration TC is Vsp, that the target potential of bias shift is a target Vsp, and that the n-th potential sensed by the photosensor is Vsp(I) regarding the TC control pattern portion and Vk(I) regarding the bias shift. Then, so long as the toner concentration control is normal, the following relation holds with most of I's:

$$|\text{target } Vsp - Vsp| < 0.1\ V \quad (5)$$

(or 0.4 V in the case of black development).

In this case, the running mean of the bias shift detection potentials Vk(I) is produced as a shift Vk, as follows:

$$Vk = (1/8) \sum_{n=2}^{8} Vk(n) \quad (6)$$

On the other hand, when the toner concentration control is not normal, the Eq. (4) does not hold, i.e., the following relation holds with some or all of I's:

$$|Vsp\ (I) - \text{target } Vsp| < 0.1\ V \quad (7)$$

(or 0.4 V in the case of black development).

In such a condition, for all of I's with which the relation (7) holds, the target value Vko of Vk is substituted for Vk(I):

$$Vk\ (I) = Vko \quad (8)$$

Then, the running means of the shifts Vk is produced with Vk(I) by use of the equation (6).

At the initial Vk correction, a potential difference greater than a small potential difference to be applied in the event of ordinary image forming operations is applied in order to reduce the deviation of toner concentration to zero rapidly. Thereafter, the program returns to ordinary Vk correction.

Figure 21:
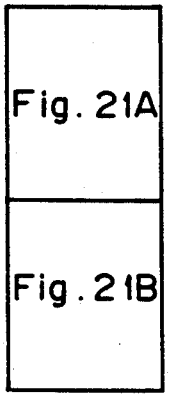
Figure 21A:
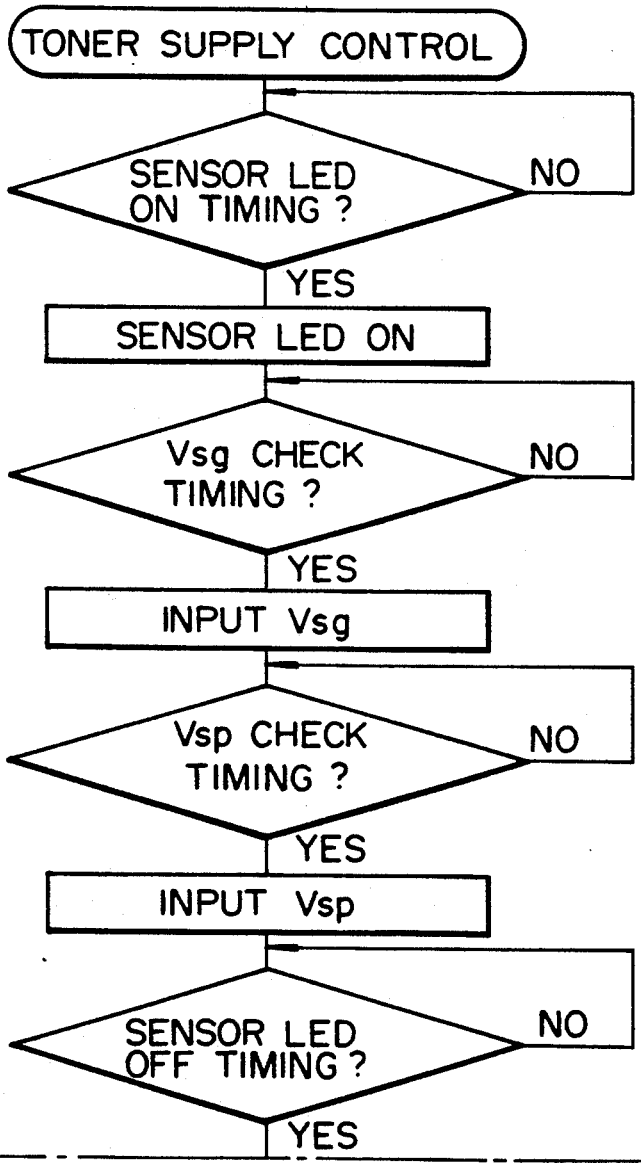
Figure 21B:
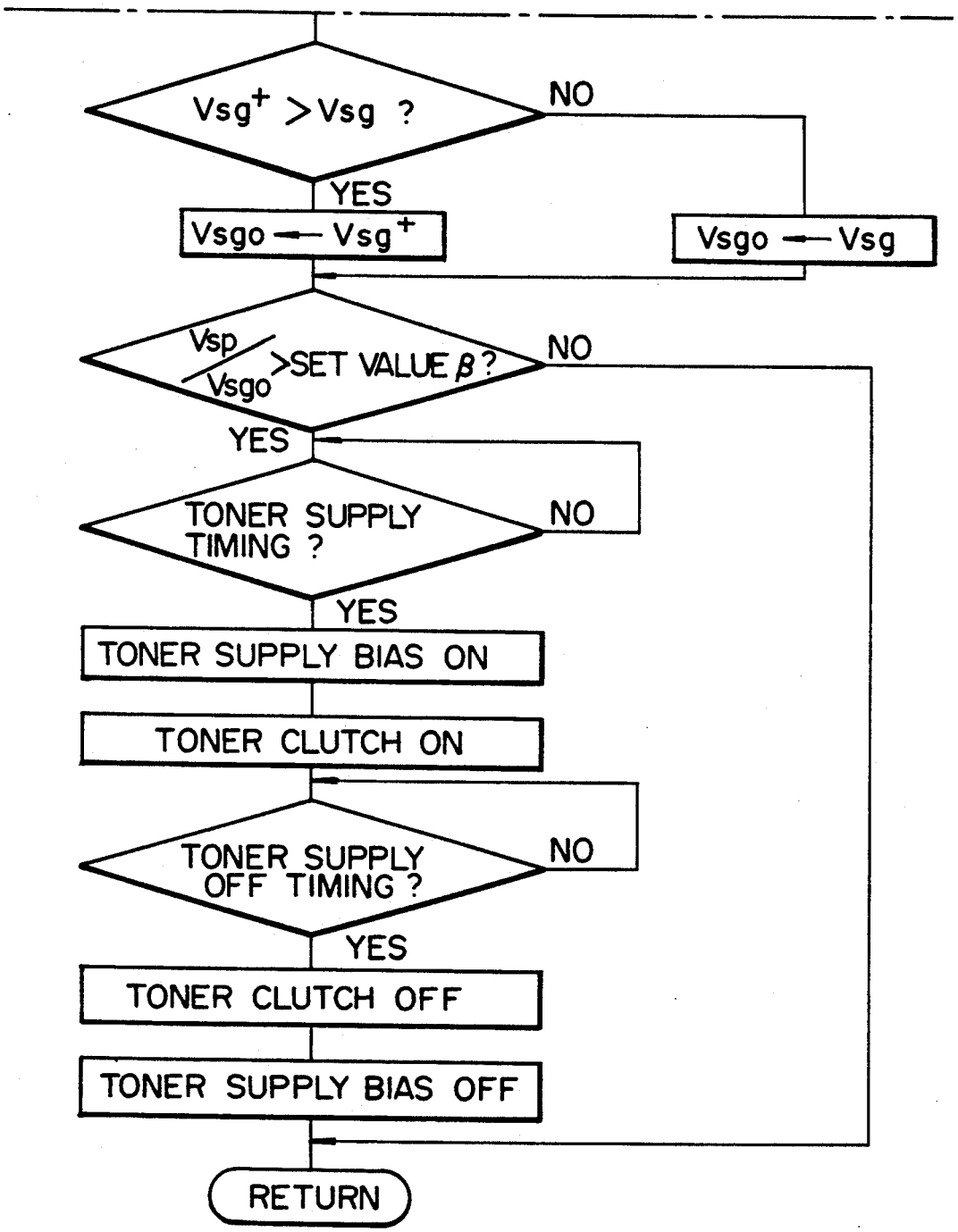

Based on the above-described control over dynamic range during image forming, the illustrative embodiment executes toner supply control, as will be described with reference to FIGS. 21A, 21B. As shown. the background potential of the photoconductive element and the density of a toner image pattern formed on the background each is sensed at a particular timing. The sensed background voltage Vsg is compared with the background voltage Vsg+ which was sensed while the developing sleeve was in a halt. If the voltage Vsg+ is higher than the voltage Vsg, the background may reasonably be considered as having not been contaminated when the developing sleeve has been in a halt and, therefore, Vsg+ is set first. If the above-mentioned relation between Vsg+ and Vsg does not hold, it is reasonable to consider that the background has been contaminated when the developing sleeve has been in a halt. Then, the current sensed background voltage Vsg+ is replaced with the above-mentioned Vsg, and processing is executed on the basis of whether or not the ratio of the sensed background voltage and the sensed pattern density voltage is greater than a predetermined coefficient, i.e., whether or not the toner has to be supplied.

Figure 22:
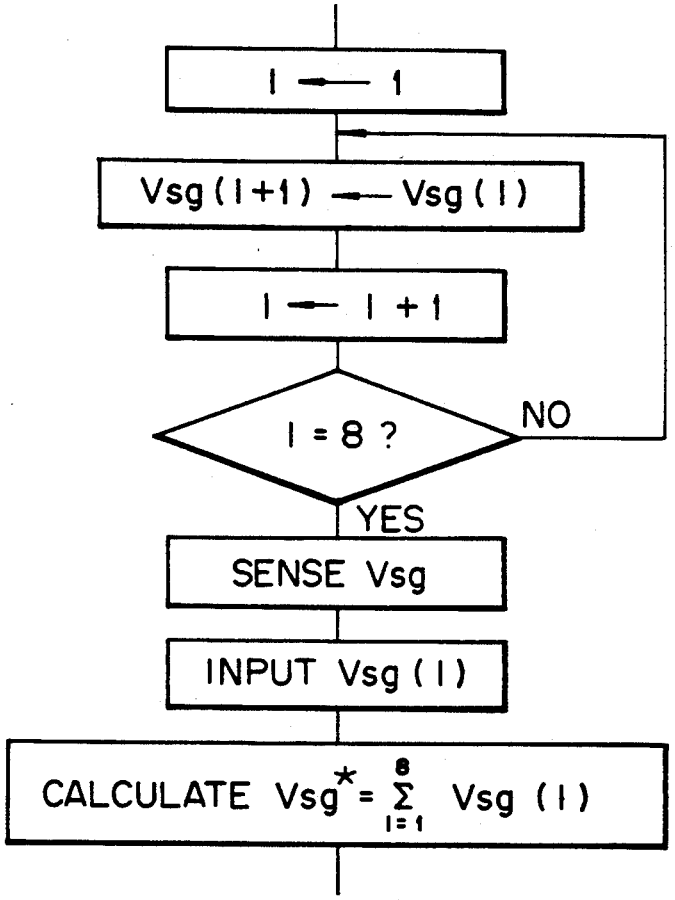

As shown in FIG. 22, in the event of the above-stated Vsg input processing, the mean value of eight consecutive data may be produced and then compared with the sensed background voltage Vsg+, as in the case of Vk control.

Figure 23A:
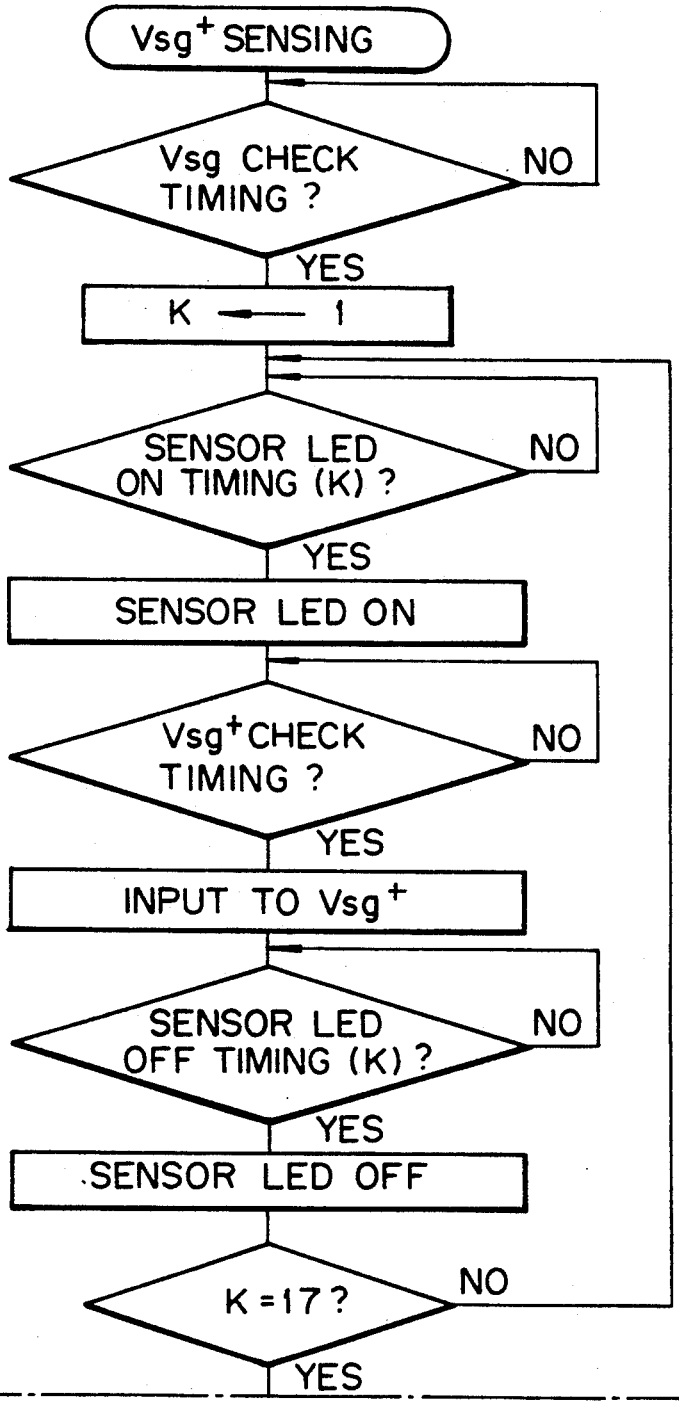
Figure 23:
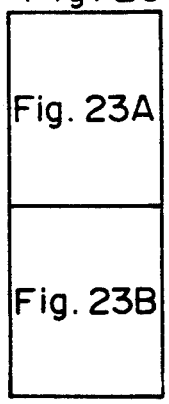
Figure 23B:
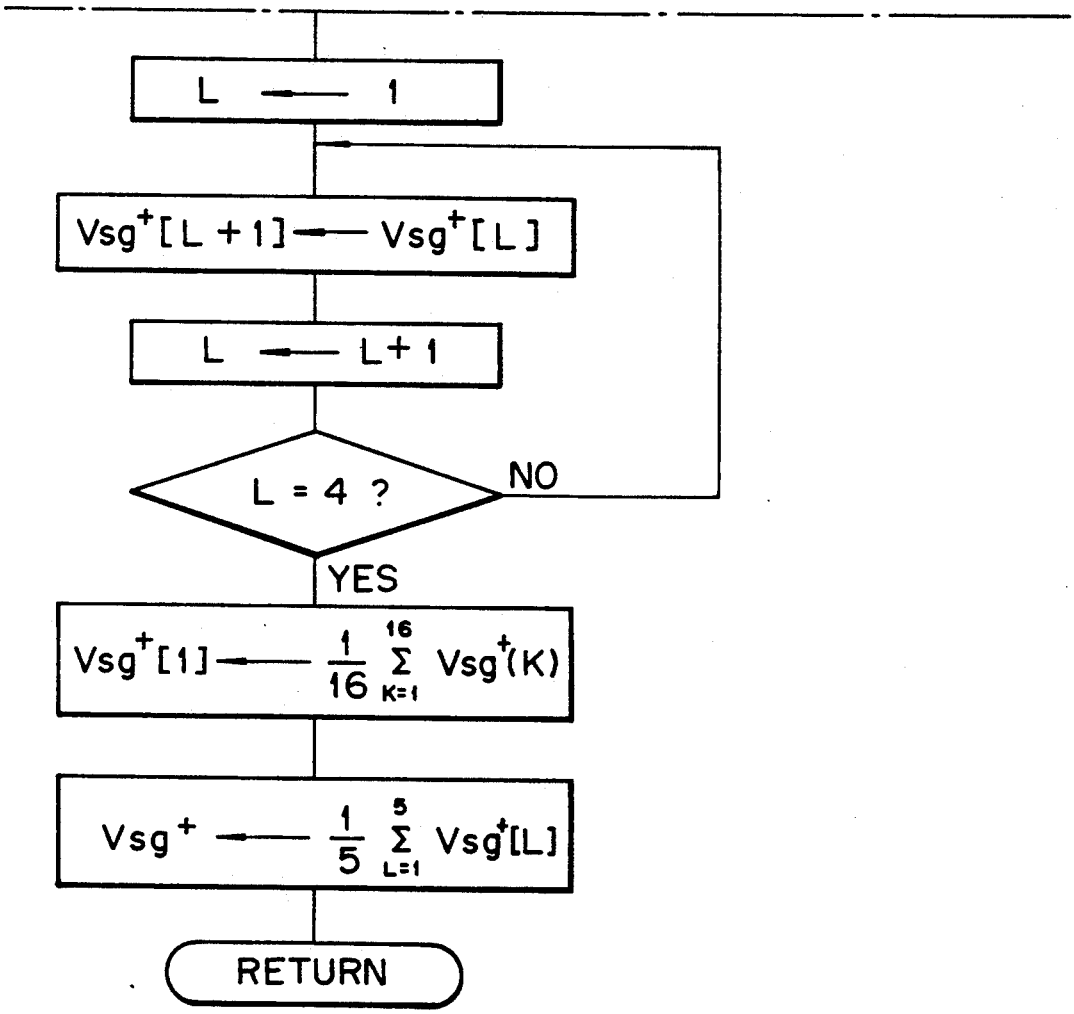

On executing such toner control, the CPU 100A determines whether or not the copying cycle should be repeated a plurality of times, as shown in FIG. 15. If the answer is positive, the CPU 100A executes processing for setting a dynamic range at the last stage and detects Vsg+. Specifically, as shown in FIGS. 23A, 23B, the CPU 100A reads a sensed background voltage every time the copy button is turned on and off, produces a mean value thereof, and then memorizes the mean value as a sensed background voltage.

Figure 24A:
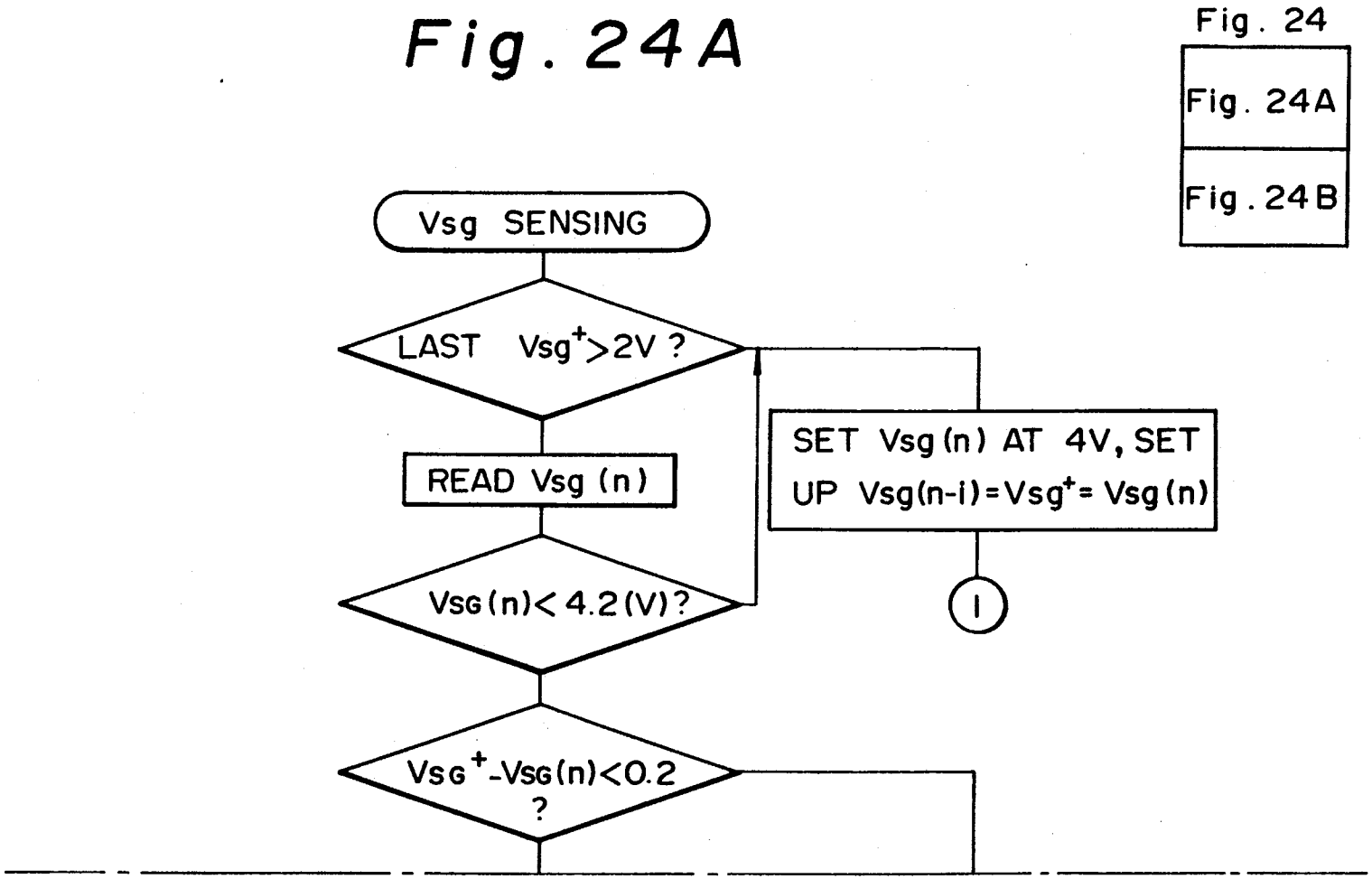
Figure 24B:
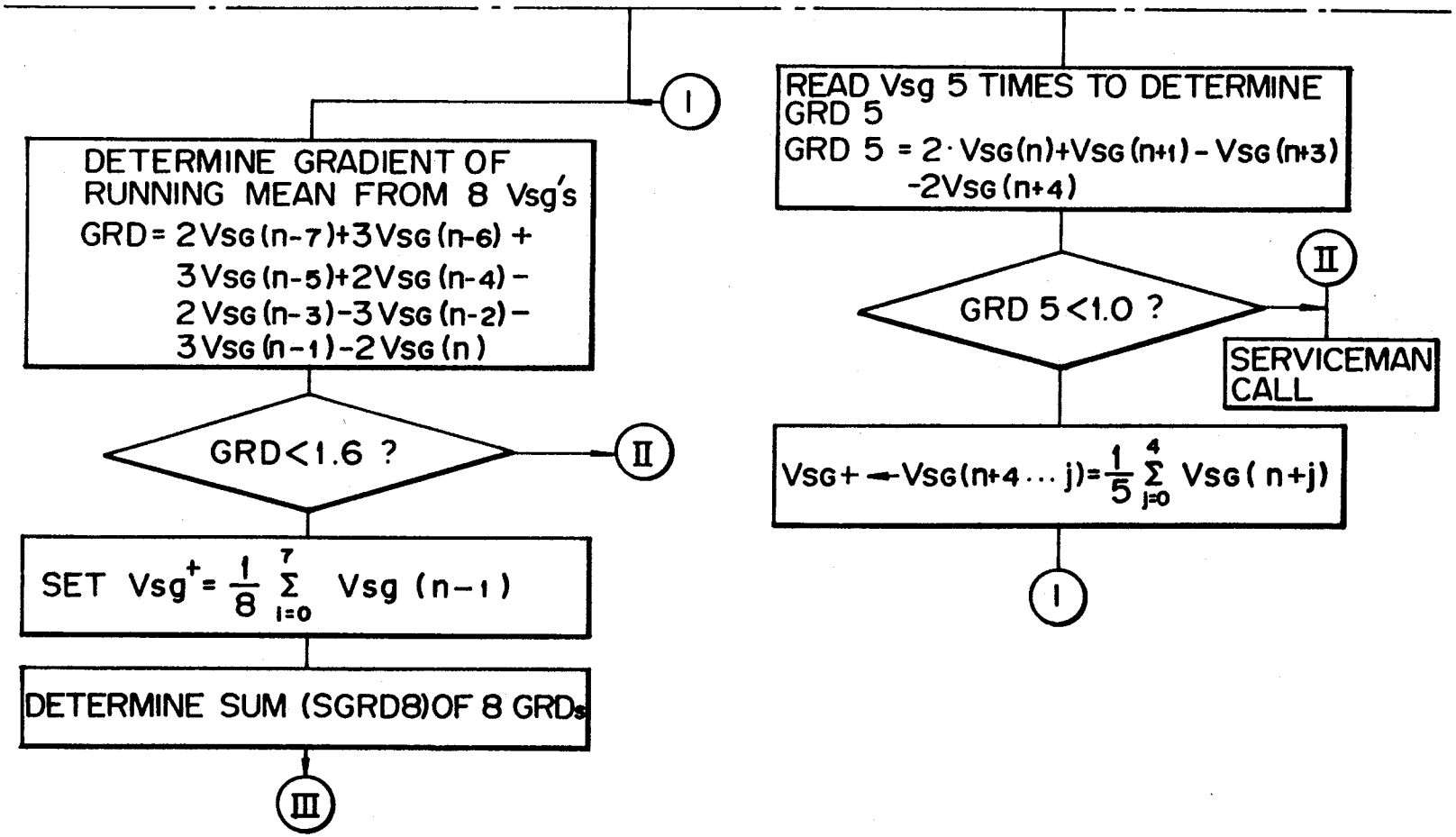
Figure 25:
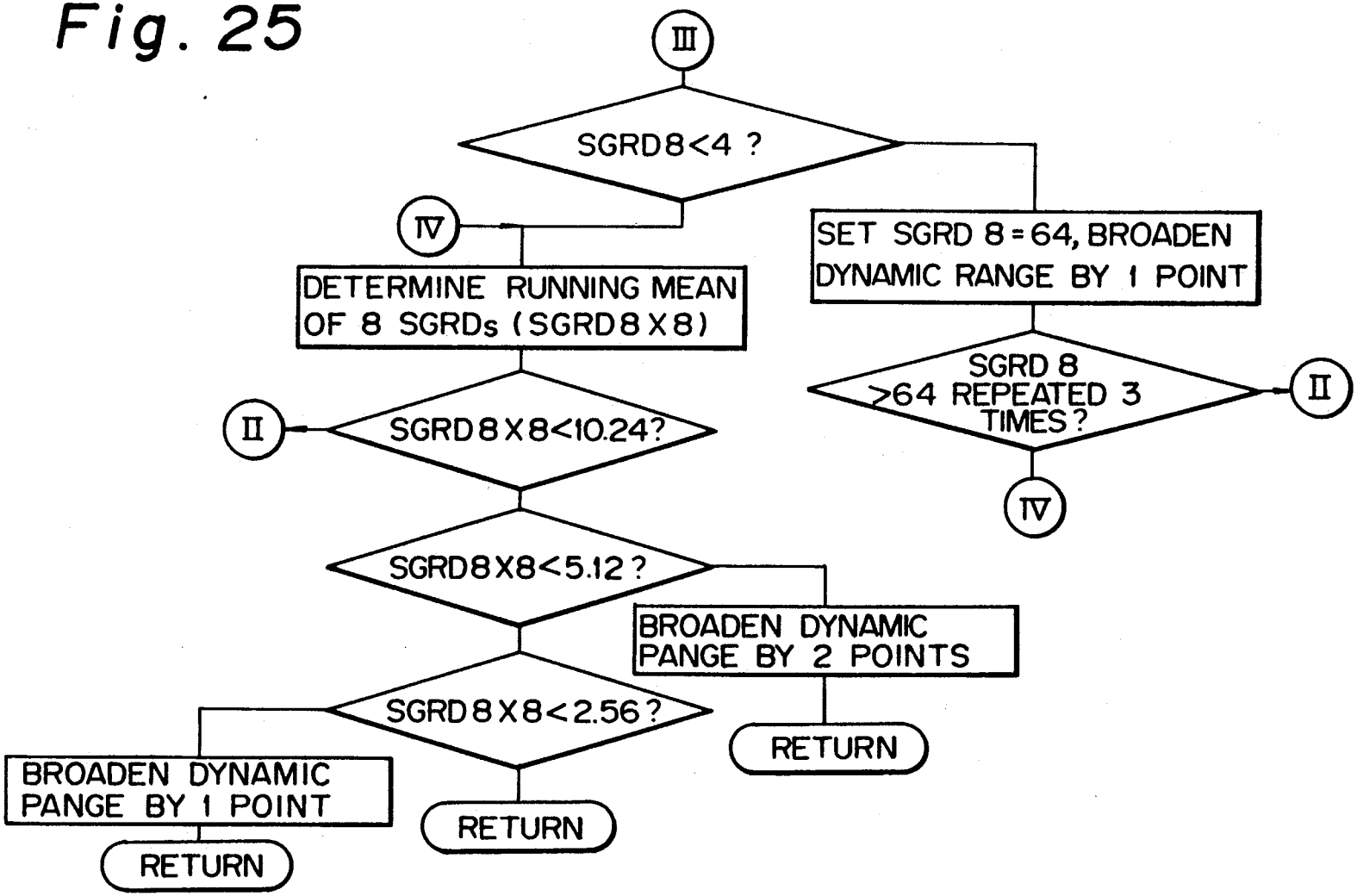

Generally, as shown in FIG. 14B, the value Vsg which is sensed when the developing sleeve is in operation is lower than the value Vsg+ which is sensed when the sleeve is out of operation due to toner deposition ascribable to rotation of the sleeve. However, the amount of reflection from the photoconductive element changes when, for example, the photoconductive element is not sufficiently cleaned after the image forming cycle or when a high toner concentration is temporarily set. The amount of reflection also changes when the surface of the photoconductive element is deteriorated or scratched. Such a charge in the amount of reflection lowers the sensed background voltage Vsg+. The illustrative embodiment determines whether or not an unusual condition has occurred on the basis of a difference between the current background potential and a background potential sensed when the developing sleeve was a halt, i.e., a reference background potential. At the same time, the embodiment corrects the dynamic range of control over the toner concentration on the photoconductive element on the basis of the above-mentioned difference. This successfully eliminates the background contamination. Specifically, as shown in FIGS. 24A, 24B, on starting the detection of a background potential, the CPU 100A determines whether or not the background potential (Vsg+) detected last time is higher than 2 V and, if the answer is negative, corrects the output of the photosensor to 4 V. Regarding the background potential (Vsg+) for this decision, use may be made of the surface potential of the non-image area of the photoconductive element sensed when the developing sleeve was in a halt and the photoconductive element was in operation. If the last background potential is higher than 2 V, the CPU 100A reads the background potential Vsg (n) to see if it is lower than 4.2 V. If the answer of this decision is negative, the CPU 100A again corrects the output of the photosensor to 4 V determining that the sensitivity has increased due to the replacement or cleaning of the photoconductive element. Since the change in the reflection from a toner image pattern is detected on the basis of the output of the photosensor which is maintained constant by the above correction, the amount of toner deposition on the photoconductive element is detected with accuracy.

On completing the photosensor output control, the CPU 100A determines a difference between the reference background potential and the sensed background potential and sees if it is smaller than a predetermined value. If the difference is greater than the predetermined value, the CPU 100A determines the gradient GRD of the sensed values to see if the change is continuous. Specifically, the CPU 100A determines whether or not the gradient of five consecutive background potentials is equal to a predetermined one to see if the change in background potential is ascribable to the contamination of the photosensor or the temporary deposition of toner on the photoconductive element. If the gradient is continuous, the CPU 100A determines that an error has occurred on the photoconductive element and executes serviceman call processing. By so determining a change in background potential in terms of the gradient of several consecutive data, it is possible to distinguish the erroneous sensing by the photosensor from actual errors. When the difference between the reference and actual background potentials is smaller than the predetermined value, i.e., when the CPU 100A does not execute such error processing, it determines the gradient of eight consecutive background potentials to see if the gradient is smaller than a predetermined one. If the actual gradient is not smaller than the predetermined one, the CPU 100A executes the above-mentioned serviceman call processing; if otherwise, it writes a mean value of sensed background potentials corresponding to seven consecutive tones in a memory. The sequence of steps described above is executed each time an image is formed.

On the other hand, the CPU 100A sums eight consecutive gradients stated above and determines whether or not the sum is smaller than a predetermined value. This decision is effected every eight copying cycles to sense the background condition at a comparatively long period. If the sum is not smaller than the predetermined value, the sum is set as the predetermined value while the previously stated dynamic range is broadened by one point. This increases the developing potential (i.e. difference between the surface potential of the photoconductive element and the developing electrode potential) and thereby lowers the toner concentration on the photoconductive element, whereby the background contamination is reduced. If the CPU 100A has determined that the above-mentioned sum is greater than the predetermined value three consecutive times, it executes the serviceman call processing determining that the equipment is uncontrollable. Further, the CPU 100A adds eight such sums and, based on a relation between the resulted sum and a predetermined value, executes the serviceman call processing or corrects the point, thereby reducing the background potential.

In summary, in accordance with the present invention, when the background voltage being sensed changes due to the background contamination of a photoconductive element having occurred when a developing sleeve has been in a halt, the dynamic range for image forming and the toner supply are controlled on the basis of a background voltage which was sensed when the sleeve was in operation. This is successful in preventing the toner concentration from running out of control due to the excessive toner supply which is apt to occur when the toner concentration is to be corrected on the basis of the above-mentioned changed background voltage and a voltage representative of a toner image pattern. Further, in accordance with the present invention, when the background voltage has changed, whether or not the change is ascribable to the erroneous operation of a photosensor is determined. Hence, is is possible to detect a condition wherein the control associated with an image forming procedure will be disabled due to the change in the surface condition of the photoconductive element or an error occurred in the image forming system. This is also successful in preventing the toner concentration from running out of control due to excessive toner supply which is apt to occur in the event of the correction of toner concentration.

Various modifications will become possible for those skilled in the art after receiving the teachings of the present disclosure without departing from the scope thereof.

What is claimed is:

1. An image forming equipment for electrostatically forming a latent image on a photoconductive element and developing the latent image by a developer containing at least a toner to produce a corresponding toner image on the photoconductive element, the equipment comprising:

a) developing means including a developing sleeve for forming a predetermined toner image pattern on the photoconductive element;

b) photosensor means for sensing a reflection from the predetermined toner image pattern; and c) control means for changing at least one of:

1) a developing bias;

2) a charge potential;

3) a quantity of exposing light; and 4) a quantity of toner supply;

in response to the output signal of the photosensor means representative of a reflection incident to the photosensor means, wherein the control means includes:

1) means for comparing:

i) a background output VSG+ of the photosensor means representative of a reflection from a non-image area of the photoconductive element and appearing when the developing sleeve is not rotating and the photoconductive element is rotating, and ii) a background output VSG of the photosensor means representative of a reflection from the photoconductive element and appearing when the developing sleeve is rotating and the photoconductive element is rotating; and 2) means for controlling at least one of the developing bias, the charge potential, the quantity of exposing light and the quantity of toner supply by using a greater of the background outputs VSG+ and VSG.

2. An image forming equipment for electrostatically forming a latent image on a photoconductive element and developing the latent image by a developer containing at least a toner to produce a corresponding toner image on the photoconductive element, the equipment comprising:

a) developing means including a developing sleeve for forming a predetermined toner image pattern on the photoconductive element;

b) photosensor means for sensing a reflection from the predetermined toner image pattern; and c) control means for changing at least one of:

1) a developing bias;

2) a charge potential;

3) a quantity of exposing light; and 4) a quantity of toner supply;

in response to the output signal of the photosensor means representative of a reflection incident to the photosensor means, wherein the control means includes:

1) means for comparing with a predetermined value a greater of:

i) a background output VSG+ of the photosensor means representative of a reflection from a non-image area of the photoconductive element and appearing when the developing sleeve is not rotating and the photoconductive element is rotating; and ii) a background output VSG of the photosensor means representative of a reflection from the photoconductive element and appearing when the developing sleeve is rotating and the photoconductive element is rotating; and 2) means for controlling the quantity of toner supply on the basis of the result of comparison of the means for comparing.

3. The equipment of claim 2, wherein the control means includes:

1) means for calculating a ratio of:

i) an output VSP of the photosensor means representative of a reflection from the predetermined toner image pattern formed on the photoconductive element; and ii) a greater of the background outputs VSG+ and VSG;

2) means for comparing the ratio with the predetermined value; and 3) means for controlling the quantity of toner supply on the basis of the result of comparison of the means for comparing.

4. The equipment of claim 3, wherein:

the control means includes means for controlling the quantity of toner supply when the ratio is greater than the predetermined value but for not controlling the quantity of toner supply when the ratio is smaller than the predetermined value.

5. The equipment of claim 4, wherein the background output VSG+ is a mean value of a plurality of background outputs.

6. An image forming equipment for electrostatically forming a latent image on a photoconductive element and developing the latent image by a developer containing at least a toner to produce a corresponding toner image on the photoconductive element, the equipment comprising:

a) developing means including a developing sleeve for forming a predetermined toner image pattern on the photoconductive element;

b) photosensor means for sensing a reflection from the predetermined toner image pattern; and c) control means for changing at least one of:

1) a developing bias;

2) a charge potential;

2) a quantity of exposing light; and 4) a quantity of toner supply;

in response to the output signal of the photosensor means representative of a reflection incident to the photosensor means, wherein the control means includes:

1) means for calculating a difference between:

i) a background output VSG+ of the photosensor means representative of a reflection from a non-image area of the photoconductive element and appearing when the developing sleeve is not rotating and the photoconductive element is rotating; and ii) a background output VSG of the photosensor means representative of a reflection from the photoconductive element and appearing when the developing sleeve is rotating and the photoconductive element is rotating;

2) means for calculating a gradient of changes of a plurality of background outputs VSG, when the difference calculated by the means for calculating is smaller than a predetermined value; and 3) means for variably controlling a dynamic range of an electrostatic latent image on the basis of the gradient.

7. An image forming equipment for electrostatically forming a latent image on a photoconductive element and developing the latent image by a developer containing at least a toner to produce a corresponding toner image on the photoconductive element, the equipment comprising:

a) developing means including a developing sleeve for forming a predetermined toner image pattern on the photoconductive element;

b) photosensor means for sensing a reflection from the predetermined toner image pattern; and c) control means for changing at least one of:

1) a developing bias;

2) a charge potential;

3) a quantity of exposing light; and 4) a quantity of toner supply;

in response to the output signal of the photosensor means representative of a reflection incident to the photosensor means, the control means including:

1) means for calculating a first gradient of changes of a plurality of background outputs VSG representative of reflections from the photoconductive element and appearing when the developing sleeve is rotating;

2) means for determining whether or not the equipment is in an unusual state on the basis of the first gradient; and 3) means for calculating a second gradient of changes of a greater number of background outputs VSG than the plurality of background outputs VSG, if the equipment is not in an unusual state; and 4) means for determining whether or not the equipment is in an unusual state on the basis of the second gradient.

8. An image forming equipment for electrostatically forming a latent image on a photoconductive element and developing the latent image by a developer containing at least a toner to produce a corresponding toner image on the photoconductive element, the equipment comprising:

a) developing means including a developing sleeve for forming a predetermined toner image pattern on the photoconductive element;

b) photosensor means for sensing a reflection from the predetermined toner image pattern; and c) control means for changing at least one of:

1) a developing bias;

2) a charge potential;

3) a quantity of exposing light; and 4) a quantity of toner supply;

in response to the output signal of the photosensor means representative of a reflection incident to the photosensor means, the control means including:

1) means for determining whether the equipment is in an unusual state, the determining occurring when each of the following outputs i) and ii) has a gradient greater than a predetermined value:

i) a background output VSG+ of the photosensor means representative of a reflection from a non-image area of the photoconductive element and appearing when the developing sleeve is not rotating and the photoconductive element is rotating; and ii) a background output VSG of the photosensor means representative of a reflection from the photoconductive element and appearing when the developing sleeve is rotating and the photoconductive element is rotating; and 2) means for determining that the equipment is in an unusual state.

9. The equipment of claim 8, wherein the control means includes:

1) means for calculating a difference between the background outputs VSG+ and VSG; and 2) means for calculating a gradient of a plurality of background outputs VSG, when the difference is greater than a predetermined value; and 3) means for determining that the equipment is in an unusual state when the gradient is greater than a predetermined value.

* * * * *